US011367400B2

(12) United States Patent
Kim et al.

(10) Patent No.: US 11,367,400 B2
(45) Date of Patent: Jun. 21, 2022

(54) DISPLAY DEVICE

(71) Applicant: Samsung Display Co., Ltd., Yongin-Si (KR)

(72) Inventors: Taehoon Kim, Hwaseong-si (KR); Soon-Dong Kim, Osan-si (KR); Changnoh Yoon, Seoul (KR); Sangan Kwon, Cheonan-si (KR); Eun Sil Yun, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/217,373

(22) Filed: Mar. 30, 2021

(65) Prior Publication Data

US 2022/0044638 A1 Feb. 10, 2022

(30) Foreign Application Priority Data

Aug. 5, 2020 (KR) ..... 10-2020-0097971

(51) Int. Cl.
*G09G 3/3266* (2016.01)
*G09G 3/3275* (2016.01)
*G09G 3/3233* (2016.01)

(52) U.S. Cl.
CPC ..... *G09G 3/3266* (2013.01); *G09G 3/3275* (2013.01); *G09G 3/3233* (2013.01); *G09G 2300/0426* (2013.01); *G09G 2300/0819* (2013.01); *G09G 2310/0202* (2013.01); *G09G 2320/10* (2013.01)

(58) Field of Classification Search
CPC combination set(s) only.
See application file for complete search history.

(56) References Cited

U.S. PATENT DOCUMENTS

| | | | | |
|---|---|---|---|---|
| 10,198,998 | B2 | 2/2019 | In et al. | |
| 10,665,172 | B2 | 5/2020 | Lee et al. | |
| 2011/0150501 | A1* | 6/2011 | Guttag | G09G 5/10 398/182 |
| 2014/0139502 | A1* | 5/2014 | Han | G09G 3/3233 345/212 |
| 2016/0217728 | A1* | 7/2016 | In | G09G 3/2096 |
| 2016/0365035 | A1* | 12/2016 | Park | G09G 3/3266 |

FOREIGN PATENT DOCUMENTS

| | | | |
|---|---|---|---|
| KR | 1020160141132 | A | 12/2016 |
| KR | 1020180057101 | A | 5/2018 |
| KR | 1020220000022 | A | 1/2022 |

* cited by examiner

*Primary Examiner* — Michael J Eurice
(74) *Attorney, Agent, or Firm* — Cantor Colburn LLP

(57) ABSTRACT

A display device includes a display panel including a first image unit and a second image unit, a data driver which applies data voltages to the display panel, a first scan driver which applies write scan signals to the display panel, a second scan driver which applies compensation scan signals and initialization scan signals to the display panel, and a masking part connected to the second scan driver and which selectively applies the initialization scan signals to the second image unit.

20 Claims, 17 Drawing Sheets

DISPLAY DEVICE

This application claims priority to Korean Patent Application No. 10-2020-0097971, filed on Aug. 5, 2020, and all the benefits accruing therefrom under 35 U.S.C. § 119, the content of which in its entirety is herein incorporated by reference.

BACKGROUND

The present disclosure herein relates to a display device.

In general, electronic devices such as smart phones, digital cameras, notebook computers, navigation systems, and smart televisions, which provide images to users, include display devices for displaying images. The display device generates an image and provides the generated image to a user through a display screen.

The display device includes a display panel including a plurality of pixels for generating an image, and a driver for driving the pixels. Each of the pixels includes a light emitting element, a plurality of transistors connected to the light emitting element, and at least one capacitor connected to the transistors.

When the display panel is driven at a driving frequency, the display panel may include a moving image unit displaying a moving picture and a still image unit displaying a still image. The moving image unit may receive continuously updated images during the driving frequency. The still image unit may maintain image data initially provided during the driving frequency, and then may not receive an image signal.

SUMMARY

The present disclosure provides a display device in which pixels of a moving image unit adjacent to a still image unit can be normally compensated.

An embodiment of the inventive concept provides a display device including: a display panel including a first image unit and a second image unit, a data driver which applies data voltages to the display panel, a first scan driver which applies write scan signals to the display panel, a second scan driver which applies compensation scan signals and initialization scan signals to the display panel, and a masking part connected to the second scan driver and which selectively applies the initialization scan signals to the second image unit.

In an embodiment of the inventive concept, a display device includes: a display panel including a first image unit with pixels in first to (i−1)-th rows and a second image unit with pixels in i-th to m-th rows; a data driver which applies data voltages to the display panel; a first scan driver which applies write scan signals to the display panel; a second scan driver which applies compensation scan signals and initialization scan signals to the display panel; and a masking part connected to the second scan driver, wherein the second scan driver comprises m+c compensation-initialization stages which output the compensation and initialization scan signals, where the masking part comprises a plurality of masking circuits connected to i-th to (i+c−1)-th compensation-initialization stages of the m+c compensation-initialization stages, respectively, and the plurality of masking circuits selectively outputs i-th to (i+c−1)-th initialization scan signals received from the i-th to (i+c−1)-th compensation-initialization stages, respectively. Here, i, m, c are natural numbers, and i is 2 or more and equal to or less than m.

BRIEF DESCRIPTION OF THE FIGURES

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings.

DETAILED DESCRIPTION

Figure 1:
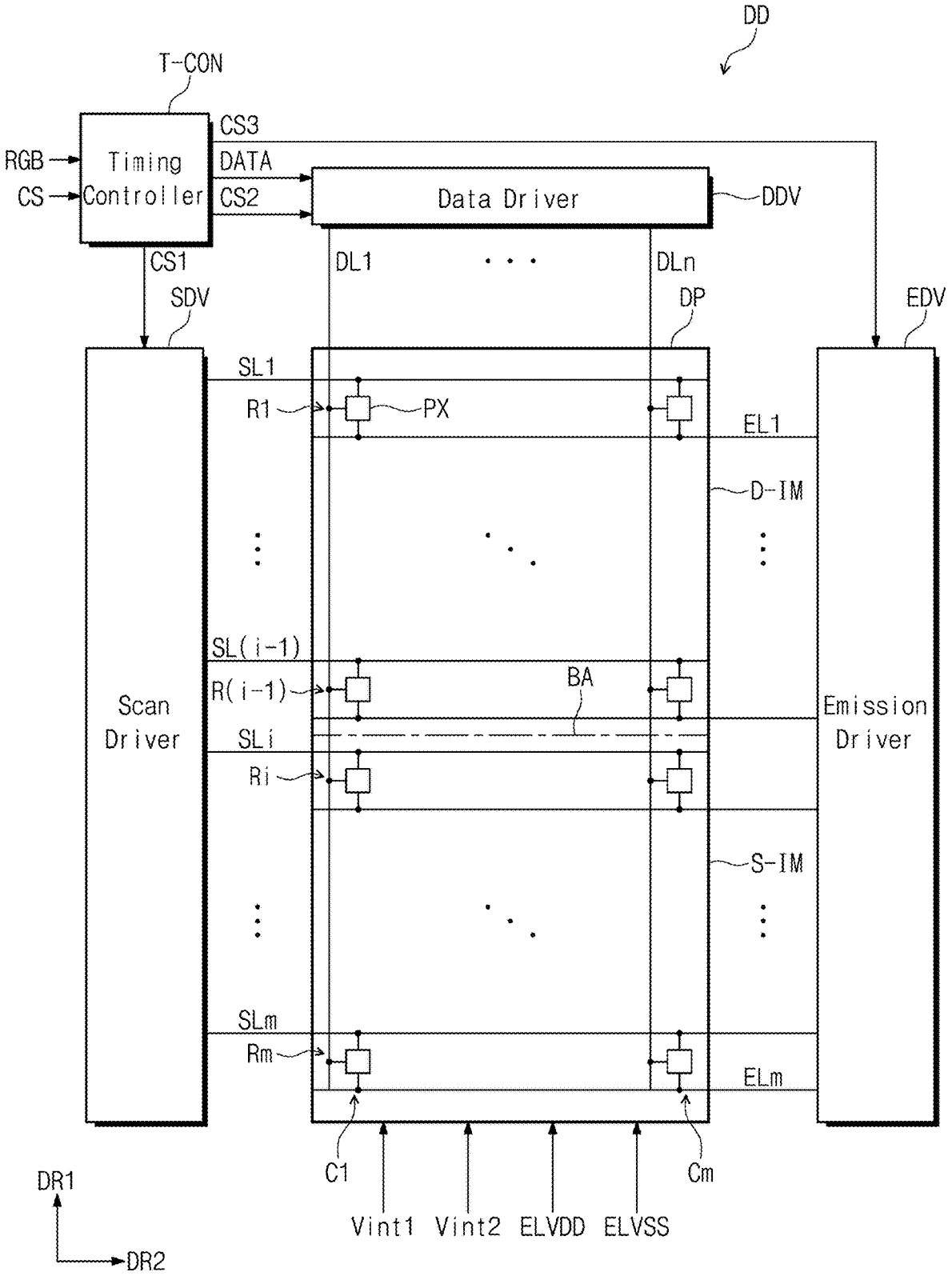
FIG. 1 is a block diagram of a display device according to an embodiment of the inventive concept.

In this specification, when an element (or region, layer, part, etc.) is referred to as being "on", "connected to", or "coupled to" another element, it means that it can be directly placed on/connected to/coupled to other components, or a third component can be arranged between them.

Like reference numerals refer to like elements. Additionally, in the drawings, the thicknesses, proportions, and dimensions of components are exaggerated for effective description.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." "And/or" includes all of one or more combinations defined by related components.

It will be understood that the terms "first" and "second" are used herein to describe various components but these components should not be limited by these terms. The above terms are used only to distinguish one component from another. For example, a first component may be referred to as a second component and vice versa without departing from the scope of the inventive concept. The terms of a singular form may include plural forms unless otherwise specified.

In addition, terms such as "below", "the lower side", "on", and "the upper side" are used to describe a relationship of configurations shown in the drawing. The terms are described as a relative concept based on a direction shown in the drawing.

Unless otherwise defined, all terms (including technical and scientific terms) used herein have the same meaning as commonly understood by one of ordinary skill in the art to which this inventive concept belongs. In addition, terms defined in a commonly used dictionary should be interpreted as having a meaning consistent with the meaning in the context of the related technology, and unless interpreted in an ideal or overly formal sense, the terms are explicitly defined herein.

In various embodiments of the inventive concept, the term "include," "comprise," "including," or "comprising," specifies a property, a region, a fixed number, a step, a process, an element and/or a component but does not exclude other properties, regions, fixed numbers, steps, processes, elements and/or components.

Hereinafter, embodiments of the inventive concept will be described in detail with reference to the drawings.

FIG. 1 is a block diagram of a display device according to an embodiment of the inventive concept.

Referring to FIG. 1, the display device DD includes a display panel DP, a scan driver SDV, a data driver DDV, an emission driver EDV, and a timing controller T-CON. The display panel DP may include a plurality of pixels PX, a plurality of scan lines SL1 to SLm, a plurality of data lines DL1 to DLn, and a plurality of emission lines EL1 to ELm. Here, m and n are natural numbers.

Each of the scan lines SL1 to SLm may include a write scan line, a compensation scan line, and an initialization scan line. The write scan line, the compensation scan line, and the initialization scan line will be shown in FIG. 2 below.

The display panel DP according to an embodiment of the inventive concept may be a light emitting display panel. For example, the display panel DP may be an organic light emitting display panel or a quantum dot light emitting display panel. In the organic light emitting display panel, the light emitting layer may include an organic light emitting material. The light emitting layer of the quantum dot light emitting display panel may include quantum dot, quantum rod, or the like. In an embodiment of the inventive concept, the display panel DP is described as an organic light emitting display panel.

The display panel DP may include a moving image unit D-IM displaying a moving image and a still image unit S-IM displaying a still image. A plurality of pixels PX may be provided to each of the moving image unit D-IM and the still image unit S-IM. The moving image unit D-IM may be referred to as a first image unit D-IM, and the still image unit S-IM may be referred to as a second image unit S-IM.

The pixels PX may be arranged in m rows R1 to Rm and n columns C1 to Cn. Each of the m rows R1 to Rm may extend in the second direction DR2, and each of then columns C1 to Cn may extend in the first direction DR1.

The moving image unit D-IM may include pixels PX arranged in the first row R1 to the (i−1)-th row R(i−1). The still image unit S-IM may include pixels PX arranged in the i-th row Ri to the m-th row Rm. Here, i may be a natural number of 2 or more. Hereinafter, the pixels PX arranged in the rows R1 to Rm are represented by the pixels PX in the rows R1 to Rm.

The scan lines SL1 to SLm may extend in the second direction DR2 and may be connected to the pixels PX and the scan driver SDV. The data lines DL1 to DLn may extend in the first direction DR1 to be connected to the pixels PX and the data driver DDV. The emission lines EL1 to ELm extend in the second direction DR2 and may be connected to the pixels PX and the emission driver EDV.

A first voltage ELVDD and a second voltage ELVSS having a lower level than the first voltage ELVDD may be applied to the display panel DP. The first voltage ELVDD and the second voltage ELVSS may be applied to the pixels PX. Although not shown in the drawing, the display device DD may further include a voltage generation unit for generating the first voltage ELVDD and the second voltage ELVSS.

A first initialization voltage Vint1 and a second initialization voltage Vint2 may be applied to the display panel DP. The first initialization voltage Vint1 and the second initialization voltage Vint2 may be applied to the pixels PX. The first initialization voltage Vint1 and the second initialization voltage Vint2 may be generated by the voltage generation unit.

The timing controller T-CON may receive image signals RGB from an external device (e.g., a system board). The timing controller T-CON may generate image data DATA by converting the data format of the image signals RGB to meet the data driver DDV and interface specifications. The timing controller T-CON may provide the image data DATA having the converted data format to the data driver DDV.

The timing controller T-CON may receive the control signal CS from an external device (e.g., a system board). The timing controller T-CON may generate and output the first control signal CS1, the second control signal CS2, and the third control signal CS3 in response to the control signal CS.

The first control signal CS1 may be defined as a scan control signal, the second control signal CS2 may be defined as a data control signal, and the third control signal CS3 may be defined as an emission control signal. The first control signal CS1 may be provided to the scan driver SDV, the second control signal CS2 may be provided to the data driver DDV, and the third control signal CS3 may be provided to the emission driver EDV.

The scan driver SDV may generate a plurality of scan signals to be provided to the display panel DP in response to the first control signal CS1. The scan signals may be applied to the pixels PX through the scan lines SL1 to SLm. The scan signals may be sequentially applied in row units to the pixels PX of the first to m-th rows R1 to Rm.

The data driver DDV may generate a plurality of data voltages corresponding to the image data DATA in response to the second control signal CS2. Data voltages may be provided to the display panel DP. The data voltages may be applied to the pixels PX through the data lines DL1 to DLn.

The emission driver EDV may generate a plurality of emission signals to be provided to the display panel DP in response to the third control signal CS3. The emission signals may be applied to the pixels PX through the emission lines EL1 to ELm.

The pixels PX may be provided with the data voltages in response to the scan signals. The pixels PX may display an image by emitting light having luminance corresponding to data voltages in response to emission signals. The emission time of the pixels PX may be controlled by emission signals.

Figure 2:
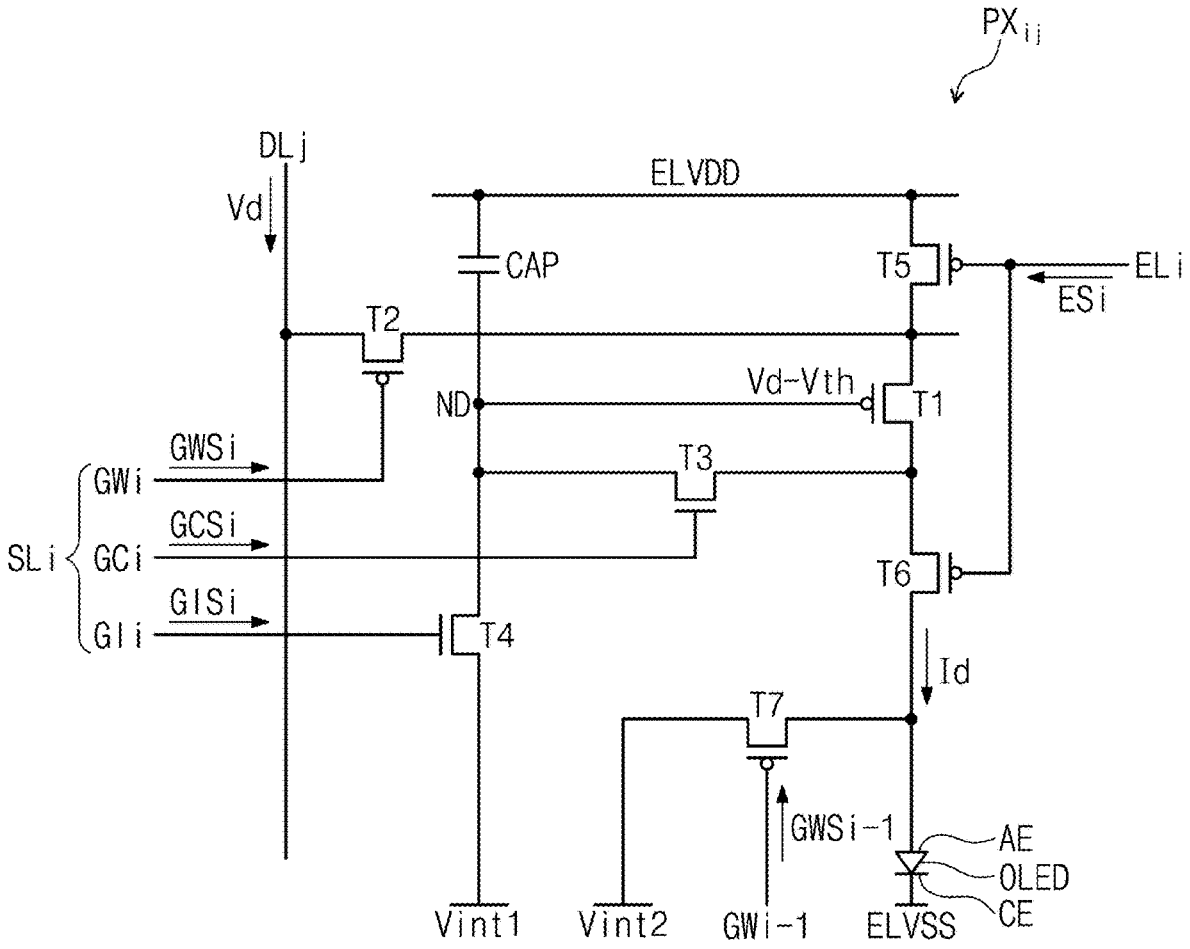
FIG. 2 is a diagram illustrating an equivalent circuit of any one pixel shown in FIG. 1.
Figure 3:
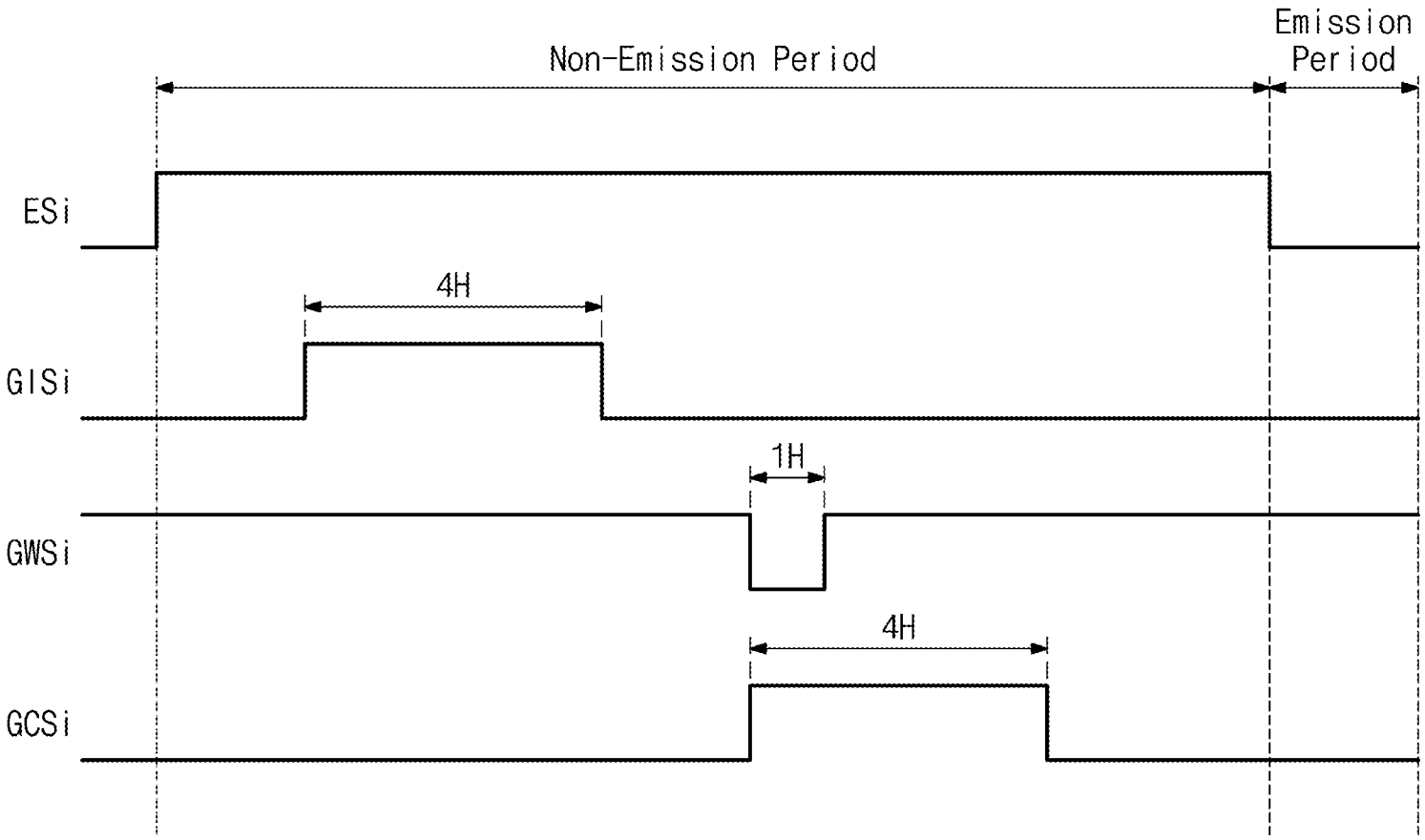
FIG. 3 is a timing diagram of signals for driving the pixel shown in FIG. 2.

FIG. 2 is a diagram illustrating an equivalent circuit of any one pixel shown in FIG. 1. FIG. 3 is a timing diagram of signals for driving the pixel shown in FIG. 2.

For example, in FIG. 2, a pixel PXij connected to an i-th scan line SLi, an i-th emission line ELi, and a j-th data line DLj is exemplarily illustrated. Here, j is a natural number equal to or less than n.

Referring to FIG. 2, the pixel PXij may include a light emitting element OLED, a plurality of transistors T1 to T7, and a capacitor CAP. The transistors T1 to T7 and the capacitor CAP may control the amount of current flowing through the light emitting element OLED in response to the data voltage. The light emitting element OLED may generate light having a predetermined luminance in response to a received amount of current.

The i-th scan line SLi may include an i-th write scan line GWi, an i-th compensation scan line GCi, and an i-th initialization scan line GIi. The i-th write scan line GWi may receive the i-th write scan signal GWSi, the i-th compensation scan line GCi may receive the i-th compensation scan signal GCSi, and the i-th initialization scan line GIi may receive an i-th initialization scan signal GISi.

Each of the transistors T1 to T7 may include a source electrode, a drain electrode, and a gate electrode. Hereinafter, in the present specification, for convenience, one of the source electrode and the drain electrode is referred to as a first electrode, and the other is defined as a second electrode. Further, the gate electrode is defined as a control electrode.

The transistors T1 to T7 may include first to seventh transistors T1 to T7. The first, second, fifth, sixth, and seventh transistors T1, T2, T5, T6, and T7 may include PMOS transistors. The third and fourth transistors T3 and T4 may include NMOS transistors.

The first transistor T1 may be defined as a driving transistor, and the second transistor T2 may be defined as a switching transistor. The third transistor T3 may be defined as a compensation transistor.

The fourth transistor T4 and the seventh transistor T7 may be defined as initialization transistors. The fifth transistor T5 may be defined as an operation control transistor, and the sixth transistor T6 may be defined as an emission control transistor.

The light emitting element OLED may be defined as an organic light emitting element. The light emitting element OLED may include an anode AE and a cathode CE. The anode AE may receive the first voltage ELVDD through the sixth, first, and fifth transistors T6, T1, and T5. The cathode CE may receive the second voltage ELVSS.

The first transistor T1 may be connected between the fifth transistor T5 and the sixth transistor T6. The first transistor T1 may include a first electrode receiving the first voltage ELVDD through the fifth transistor T5, a second electrode connected to the anode AE through the sixth transistor T6, and a control electrode connected to the node ND.

The first electrode of the first transistor T1 may be connected to the fifth transistor T5, and the second electrode of the first transistor T1 may be connected to the sixth transistor T6. The first transistor T1 may control an amount of current flowing through the light emitting element OLED according to a voltage applied to the control electrode of the first transistor T1.

The second transistor T2 may be connected between the data line DLj and the first electrode of the first transistor T1. The second transistor T2 may include a first electrode connected to the data line DLj, a second electrode connected to the first electrode of the first transistor T1, and a control electrode connected to the i-th write scan line GWi.

The second transistor T2 is turned on by the i-th write scan signal GWSi applied through the i-th write scan line Gwi to electrically connect the data line DLj and the first electrode of the first transistor T1. The second transistor T2 may perform a switching operation of providing the data voltage Vd applied through the data line DLj to the first electrode of the first transistor T1.

The third transistor T3 may be connected between the second electrode of the first transistor T1 and the node ND. The third transistor T3 may include a first electrode connected to the second electrode of the first transistor T1, a second electrode connected to the node ND, and a control electrode connected to the i-th compensation scan line GCi.

The third transistor T3 is turned on by the i-th compensation scan signal GCSi applied through the i-th compensation scan line Gci to electrically connect the second electrode of the first transistor T1 and the control electrode of the first transistor T1. When the third transistor T3 is turned on, the first transistor T1 and the third transistor T3 may be connected in a diode shape.

The fourth transistor T4 may be connected to the node ND. The fourth transistor T4 may include a first electrode connected to the node ND, a second electrode to which the first initialization voltage Vint1 is applied, and a control electrode connected to the i-th initialization scan line GIi. The fourth transistor T4 may be turned on by an i-th initialization scan signal GISi applied through the i-th initialization scan line GIi to provide the first initialization voltage Vint1 to the node ND.

The fifth transistor T5 may include a first electrode receiving a first voltage ELVDD, a second electrode connected to the first electrode of the first transistor T1, and a control electrode connected to the i-th emission line ELi.

The sixth transistor T6 may include a first electrode connected to the second electrode of the first transistor T1, a second electrode connected to the anode AE, and a control electrode connected to the i-th emission line ELi.

The fifth and sixth transistors T5 and T6 may be turned on by the i-th emission signal ESi applied through the i-th emission line ELi. The first voltage ELVDD is provided to the light emitting element OLED by the turned-on fifth transistor T5 and sixth transistor T6, so that a driving current may flow through the light emitting element OLED. Accordingly, a light emitting element OLED can emit light.

The seventh transistor T7 may include a first electrode connected to the anode AE, a second electrode receiving the second initialization voltage Vint2, and a control electrode connected to the (i−1)-th write scan line GWi−1. The (i−1)-th write scan line GWi−1 may be defined as a write scan line at a stage before the i-th write scan line GWi.

The seventh transistor T7 is turned on by the (i−1)-th write scan signal GWSi−1 applied through the (i−1)-th write scan line GWi−1 to provide the second initialization voltage Vint2 to the anode AE of the light emitting element OLED.

In another embodiment of the inventive concept, the seventh transistor T7 may be omitted. In an embodiment of the inventive concept, the second initialization voltage Vint2 may have the same level as the first initialization voltage Vint1, but is not limited thereto and may have a different level from the first initialization voltage Vint1 in another embodiment.

The capacitor CAP may include a first electrode receiving the first voltage ELVDD and a second electrode connected to the node ND. When the fifth transistor T5 and the sixth transistor T6 are turned on, the amount of current flowing through the first transistor T1 may be determined according to the voltage stored in the capacitor CAP.

Hereinafter, the operation of the pixel PXij will be described in more detail with reference to the timing diagram of FIG. 3.

Referring to FIGS. 2 and 3, the i-th emission signal ESi may have a high level during a non-emission period and a low level during the emission period.

The activation section of the i-th write scan signal GWSi may be defined as a low level of the i-th write scan signal GWSi. The activation sections of the i-th compensation scan signal GCSi and the i-th initialization scan signal GISi may be defined as high levels of the i-th compensation scan signal GCSi and the i-th initialization scan signal GISi, respectively.

In an embodiment, for example, the activation section 4H of the i-th initialization scan signal GISi and the activation section 4H of the i-th compensation scan signal GCSi may be four times the activation section 1H of the i-th write scan signal GWSi.

After the i-th initialization scan signal GISi is activated, the i-th write scan signal GWSi and the i-th compensation scan signal GCSi may be activated. During the non-emission period, an i-th initialization scan signal GISi, an i-th write scan signal GWSi, and an i-th compensation scan signal GCSi, each activated, may be applied to the pixel PXij.

Hereinafter, an operation in which each signal is applied to a corresponding transistor may refer to an operation in which an activated signal is applied to the transistor.

The i-th initialization scan signal GISi is applied to the fourth transistor T4 so that the fourth transistor T4 may be turned on. The first initialization voltage Vint1 may be provided to the node ND through the fourth transistor T4. Accordingly, the first initialization voltage Vint1 may be applied to the control electrode of the first transistor T1, and the first transistor T1 may be initialized by the first initialization voltage Vint1.

Although not shown in the timing diagram of FIG. 3, the (i−1)-th write scan signal GWSi−1 activated before the i-th write scan signal GWSi is applied to the seventh transistor T7 and thus the seventh transistor T7 can be turned on. A second initialization voltage Vint2 is provided to the anode AE through the seventh transistor T7 so that the anode AE may be initialized with the second initialization voltage Vint2.

Thereafter, the i-th write scan signal GWSi is applied to the second transistor T2 so that the second transistor T2 may be turned on. Also, the i-th compensation scan signal GCSi may be applied to the third transistor T3 to turn on the third transistor T3.

Accordingly, the first transistor T1 and the third transistor T3 may be connected to each other in the form of a diode. In this case, the compensation voltage Vd−Vth reduced by the threshold voltage Vth of the first transistor T1 from the data voltage Vd supplied through the data line DLj may be applied to the control electrode of the first transistor T1.

A first voltage ELVDD and a compensation voltage Vd−Vth may be applied to the first electrode and the second electrode of the capacitor CAP, respectively. Charges corresponding to a voltage difference between the voltage of the first electrode and the voltage of the second electrode may be stored in the capacitor CAP.

Thereafter, during the emission period, the i-th emission signal ESi is applied to the fifth transistor T5 and the sixth transistor T6 through the i-th emission line ELi, so that the fifth transistor T5 and the sixth transistor T6 may be turned on. In this case, a driving current Id corresponding to a voltage difference between the voltage of the control electrode of the first transistor T1 and the first voltage ELVDD may be generated. The driving current Id is provided to the light emitting element OLED through the sixth transistor T6 so that the light emitting element OLED can emit light.

During the emission period, by the capacitor CAP, the gate-source voltage Vgs of the first transistor T1 may be defined as a voltage difference between the first voltage ELVDD and the compensation voltage Vd−Vth as shown in Equation 1 below.

$$Vgs = \text{ELVDD} - (Vd - Vth) \quad \text{[Equation 1]}$$

The relationship between the current and voltage of the first transistor T1 is shown in Equation 2 below. Equation 2 is a current and voltage relationship of a general transistor.

$$Id = (1/2)\mu\text{Cox}(W/L)(Vgs - Vth)^2 \quad \text{[Equation 2]}$$

When Equation 1 is substituted into Equation 2, the threshold voltage Vth is removed, and the driving current Id may be proportional to a square value $(\text{ELVDD}-\text{Vd})^2$ of a value obtained by subtracting the data voltage Vd from the first voltage ELVDD. Accordingly, the driving current Id may be determined regardless of the threshold voltage Vth of the first transistor T1. This operation may be defined as a threshold voltage compensation operation.

Figure 4:
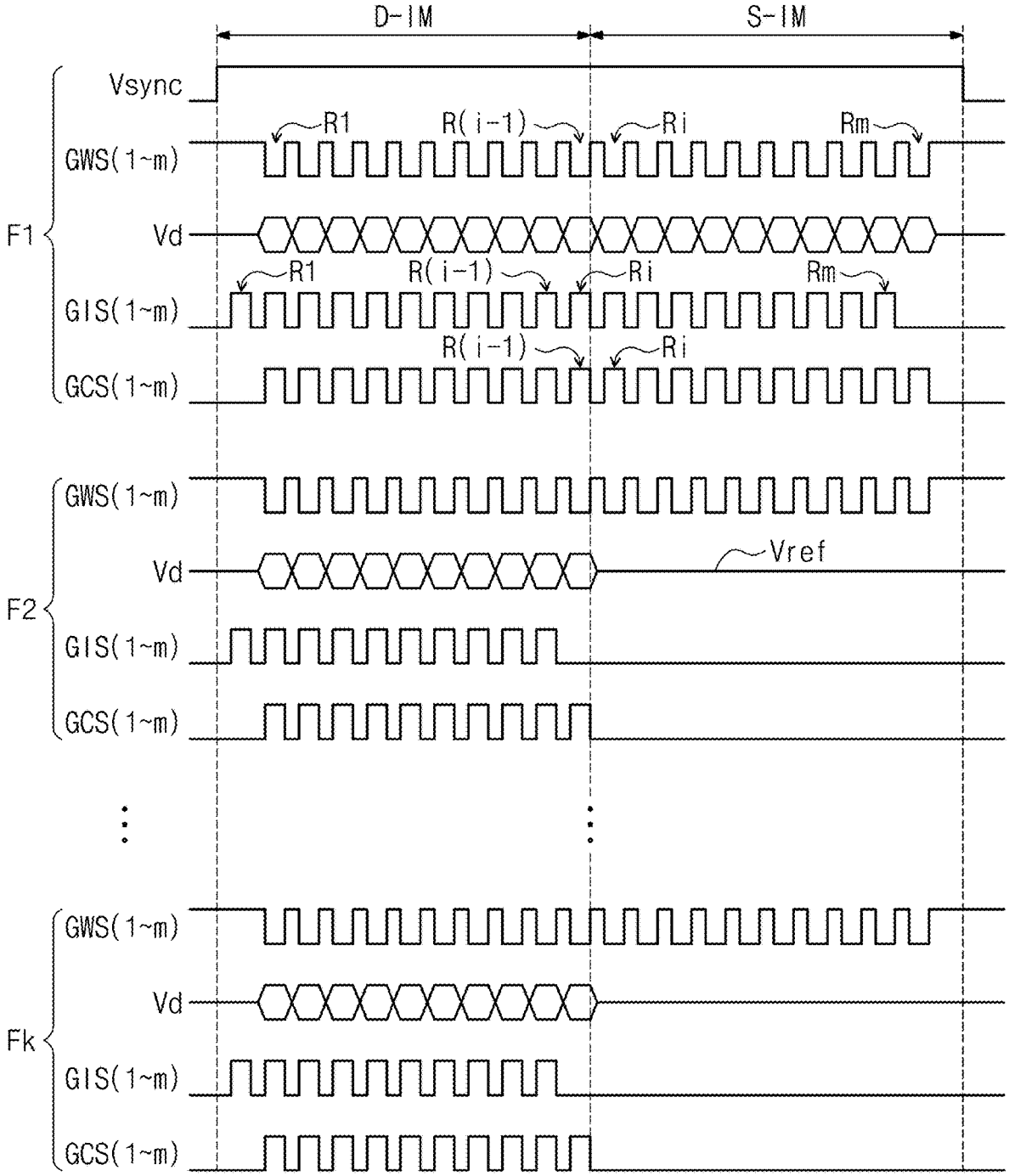
FIG. 4 is a diagram illustrating timing of signals and data voltages applied to pixels during k frames.

FIG. 4 is a diagram illustrating timing of signals and data voltages applied to pixels during k frames.

Referring to FIG. 4, the vertical start signal Vsync is substantially a signal corresponding to one frame, and in synchronization with the vertical start signal Vsync, write scan signals GWS(1 to m), initialization scan signals GIS(1 to m), compensation scan signals GCS(1 to m), and data Voltages Vd may be applied to the pixels PX.

For example, in FIG. 4, write scan signals GWS(1 to m), initialization scan signals GIS(1 to m), and compensation scan signals GCS(1 to m) are not shown in the same activation section, and are shown only with the timing applied to the first to m-th rows.

The write scan signals GWS(1 to m) may include a first write scan signal GWS1 to an m-th write scan signal GWSm. The initialization scan signals GIS(1 to m) may include a first initialization scan signal GIS1 to an m-th initialization scan signal GISm. The compensation scan signals GCS(1 to m) may include a first compensation scan signal GCS1 to an m-th compensation scan signal GCSm.

The pixels PX of the display panel DP may be driven by k frames. In the first frame F1, write scan signals GWS(1 to m), initialization scan signals GIS(1 to m), and compensation scan signals GCS(1 to m) may be applied to the pixels PX of the moving image unit D-IM and the pixels PX of the still image unit S-IM. In the first frame F1, the data voltages Vd may be applied to the pixels PX of the moving image unit D-IM and the pixels PX of the still image unit S-IM.

The write scan signals GWS(1 to m) may be sequentially applied to the pixels PX of the first to m-th rows R1 to Rm in row units. The initialization scan signals GIS(1 to m) may be sequentially applied to the pixels PX of the first to m-th rows R1 to Rm in row units. The compensation scan signals GCS(1 to m) may be sequentially applied to the pixels PX of the first to m-th rows R1 to Rm in row units.

During the second to k-th frames F2 to Fk, write scan signals GWS(1 to m) may be applied to the pixels PX of the first to m-th rows R1 to Rm. During the second to k-th frames F2 to Fk, the data voltages Vd may be applied to the pixels PX of the moving image unit D-IM. For example, during the second to k-th frames F2 to Fk, the data voltages Vd are applied to the pixels PX of the first to (i−1)-th rows R1 to R(i−1).

During the second to k-th frames F2 to Fk, the data voltages Vd may not be applied to the pixels PX of the still image unit S-IM. For example, during the second to k-th frames F2 to Fk, the data voltages Vd may not be applied to the pixels PX of the i-th to m-th rows Ri to Rm. A reference voltage Vref having a predetermined DC level may be applied to the pixels PX of the still image unit S-IM during the second to k-th frames F2 to Fk. For example, the reference voltage Vref may be a voltage corresponding to black luminance.

During the second to k-th frames F2 to Fk, the initialization scan signals GIS(1 to m) and the compensation scan signals GCS(1 to m) may be applied to the pixels PX of the moving image unit D-IM, and may not be applied to the pixels PX of the still image unit S-IM. For example, during the second to k-th frames F2 to Fk, the initialization scan signals GIS(1 to m) and the compensation scan signals GCS(1 to m) may be applied to the pixels PX of the first to (i−1)-th rows R1 to R(i−1), and may not be applied to the pixels PX of the i-th to m-th rows Ri to Rm.

The third and fourth transistors T3 and T4 may include NMOS transistors. NMOS transistors may have a smaller off-leakage current than PMOS transistors.

When a still image is displayed in the still image unit S-IM, the third and fourth transistors T3 and T4 may be turned off during the second to k-th frames F2 to Fk. Since the off-leakage currents of the third and fourth transistors T3 and T4 are smaller, the amount of discharge of the capacitor CAP is reduced, so that the state of charge of the capacitor CAP can be more easily maintained. Accordingly, during the second to k-th frames F2 to Fk, the amount of charge charged in the capacitor CAP is more easily maintained such that the pixels PX can normally display a still image.

Transistors may have hysteresis characteristics. Current flowing through the first transistors T1 may vary according to the hysteresis characteristics of the first transistors T1.

Hysteresis characteristics may be changed when data voltages applied to the source electrodes (e.g., first electrodes) of the first transistors T1 are different in the current frame and the previous frame. When the hysteresis characteristic is changed, the gate-source voltage versus the source-drain current curve is different, so the change in the hysteresis characteristic may affect the luminance.

In order for the still image unit S-IM to display a still image, the hysteresis characteristics of the first transistors T1 of the pixels PX arranged in the still image unit S-IM must be kept constant.

In an embodiment of the inventive concept, by applying the reference voltage Vref to the source electrodes of the first transistors T1 disposed in the still image unit S-IM, the first transistor T1 may be in an on-bias state. In this case, changes in hysteresis characteristics of the first transistors T1 for displaying a still image may be reduced, such that the hysteresis characteristics of the first transistors T1 may be kept more constant.

Figure 5:
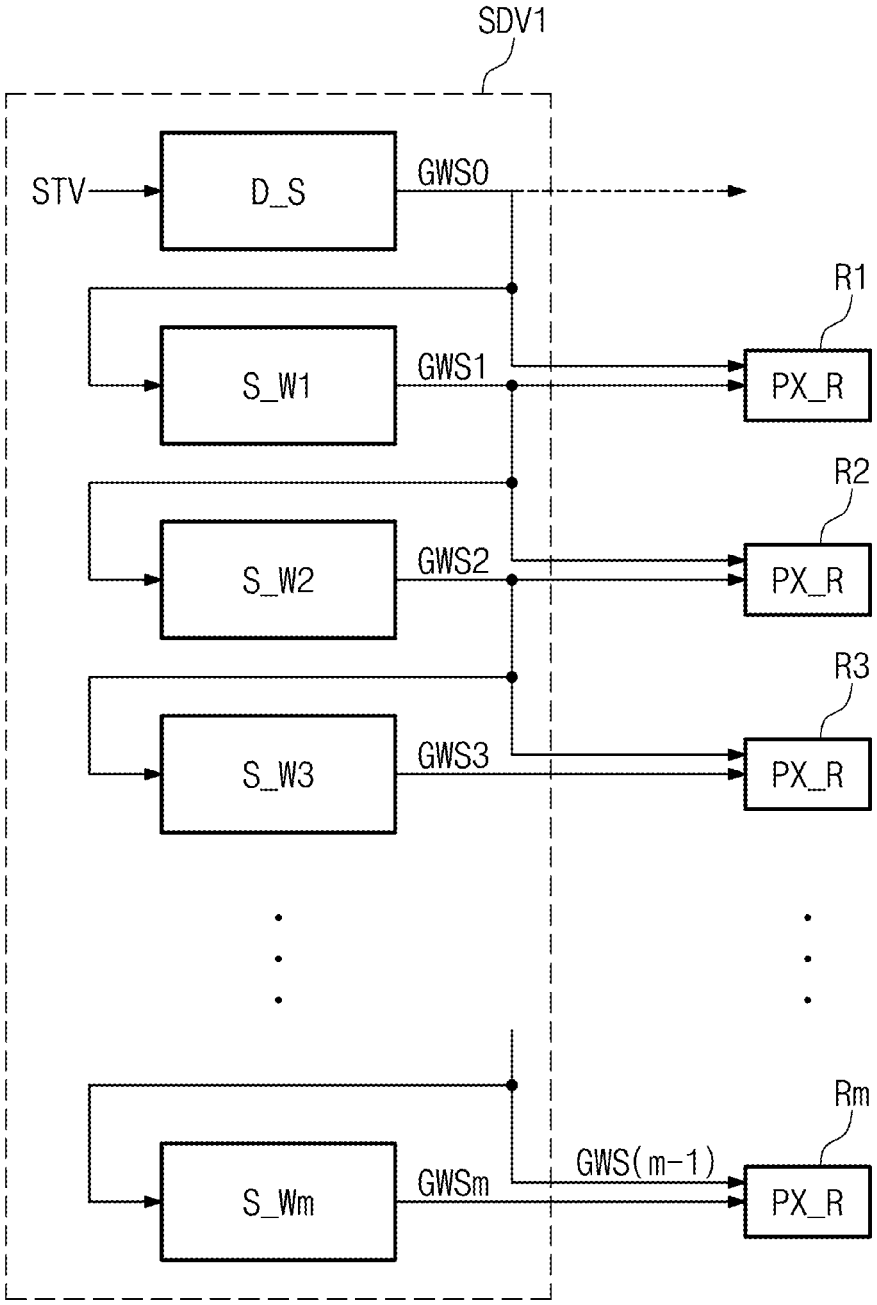
FIG. 5 is a diagram illustrating a configuration of a first scan driver of the scan driver shown in FIG. 1.
Figure 6:
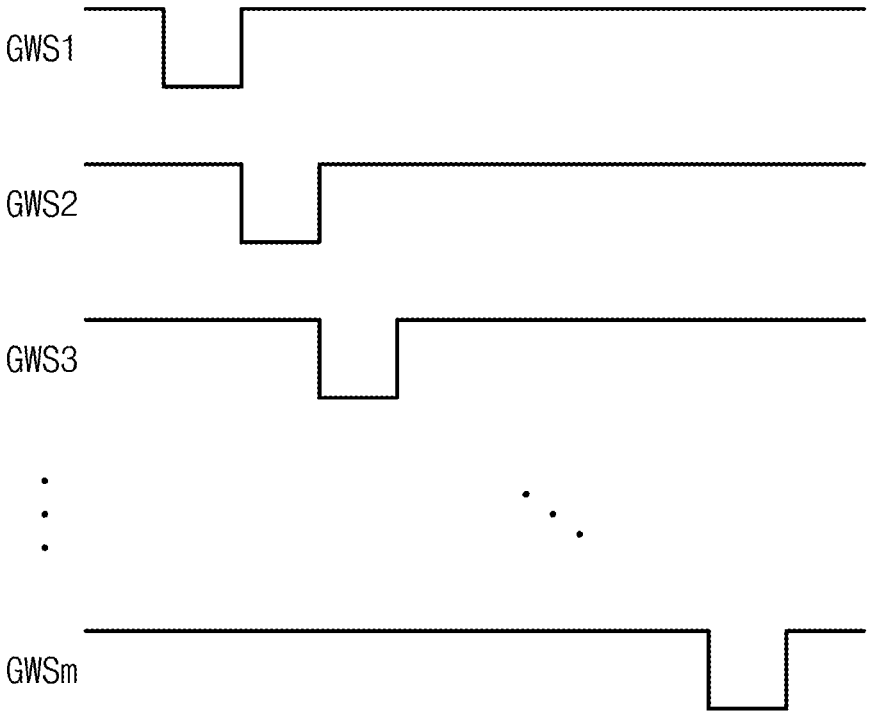
FIG. 6 is a timing diagram of write scan signals outputted from the write stages shown in FIG. 5.

FIG. 5 is a diagram illustrating a configuration of a first scan driver of the scan driver shown in FIG. 1. FIG. 6 is a timing diagram of write scan signals outputted from the write stages shown in FIG. 5.

In the following drawings, by way of example, the pixels PX arranged in a row are illustrated as one block and described as pixels PX_R.

Referring to FIGS. 5 and 6, the scan driver SDV may include a first scan driver SDV1 for generating a plurality of write scan signals GWS1 to GWSm and applying them to the display panel DP.

The first scan driver SDV1 may include a plurality of write stages S_W1 to S_Wm and at least one dummy stage D_S. The write stages S_W1 to S_Wm may output a plurality of write scan signals GWS1 to GWSm, respectively. The write scan signals GWS1 to GWSm may be the write scan signals GWS(1 to m) described with reference to FIG. 4. The dummy stage D_S may output a dummy write scan signal GWS0.

The pixels PX_R in the h-th row may receive an h-th write scan signal outputted from the h-th write stage and an (h−1)-th write scan signal outputted from the (h−1)-th write stage. Here, h is a natural number. The h-th write scan signal may be a write scan signal applied to the above-described second transistor T2, and the (h−1)-th write scan signal may be a write scan signal applied to the seventh transistor T7.

In an embodiment, for example, if h is 3, the pixels PX_R of the third row R3 may receive a third write scan signal GWS3 outputted from the third write stage S_W3 and a second write scan signal GWS2 outputted from the second write stage S_W2. The third write scan signal GWS3 may be applied to the second transistor T2 of each of the pixels PX_R of the third row R3, and the second write scan signal GWS2 may be applied to the seventh transistor T7 of each of the pixels PX_R of the third row R3.

The h-th write stage may be driven by receiving the (h−1)-th write scan signal outputted from the (h−1)-th write stage. In this case, the (h−1)-th write scan signal may be defined as a carry signal. For example, when h is 3, the third write stage S_W3 may be driven by receiving the second write scan signal GWS2 to output the third write scan signal GWS3. Accordingly, as shown in FIG. 6, write scan signals GWS1 to GWSm may be sequentially outputted.

The dummy stage D_S may be used to apply a previous write scan signal to the pixels PX_R in the first row R1. For example, the dummy stage D_S outputs a dummy write scan signal GWS0, and the dummy write scan signal GWS0 may be applied to the seventh transistor T7 of each of the pixels PX_R of the first row R1. The first write stage S_W1 may be driven by receiving a dummy write scan signal GWS0 as a carry signal. The dummy stage D_S may be driven by receiving the start signal STV.

Figure 7:
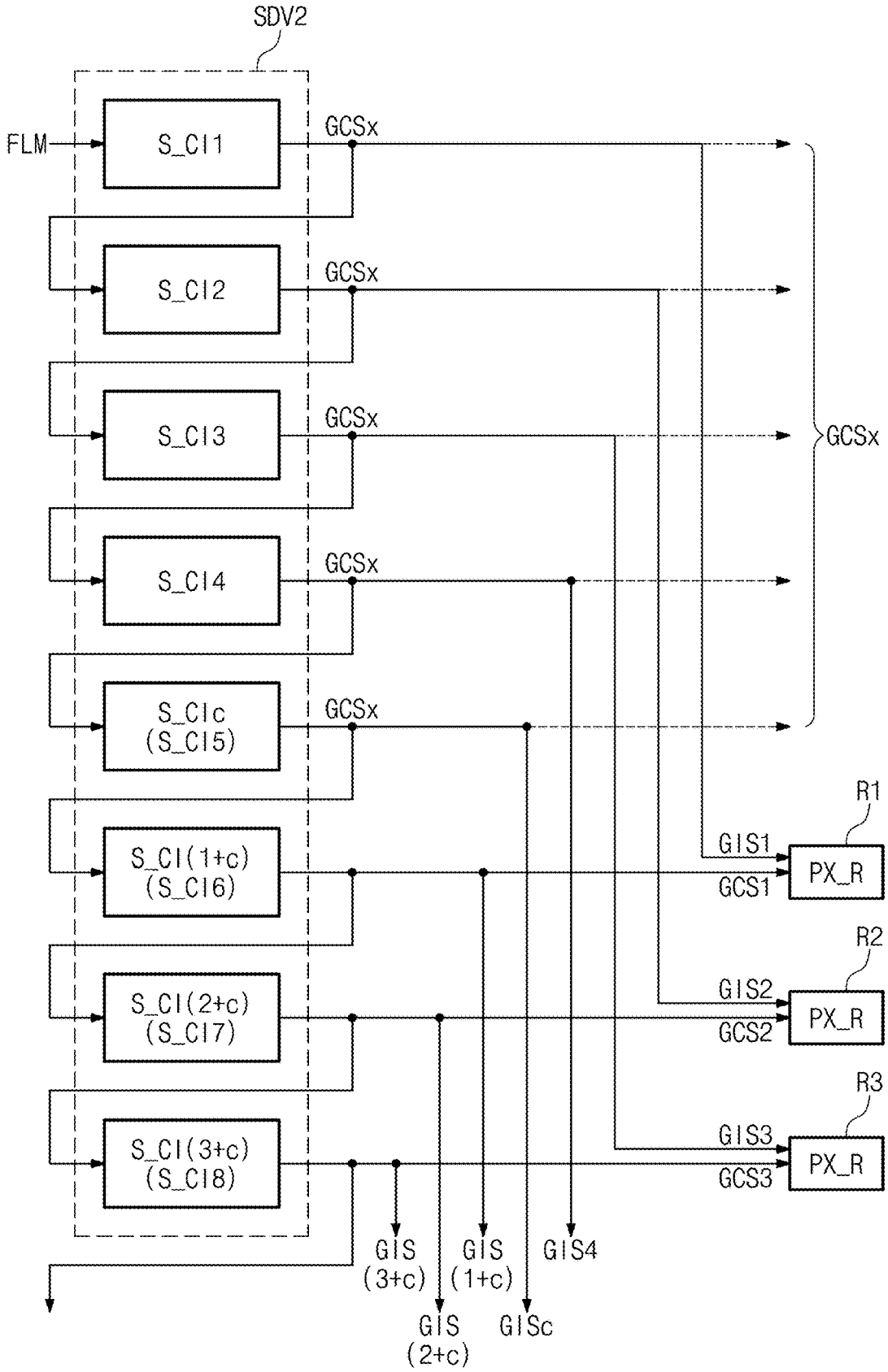
FIGS. 7, 8, and 9 are diagrams showing the configuration of a second scan driver of the scan driver shown in FIG. 1.
Figure 8:
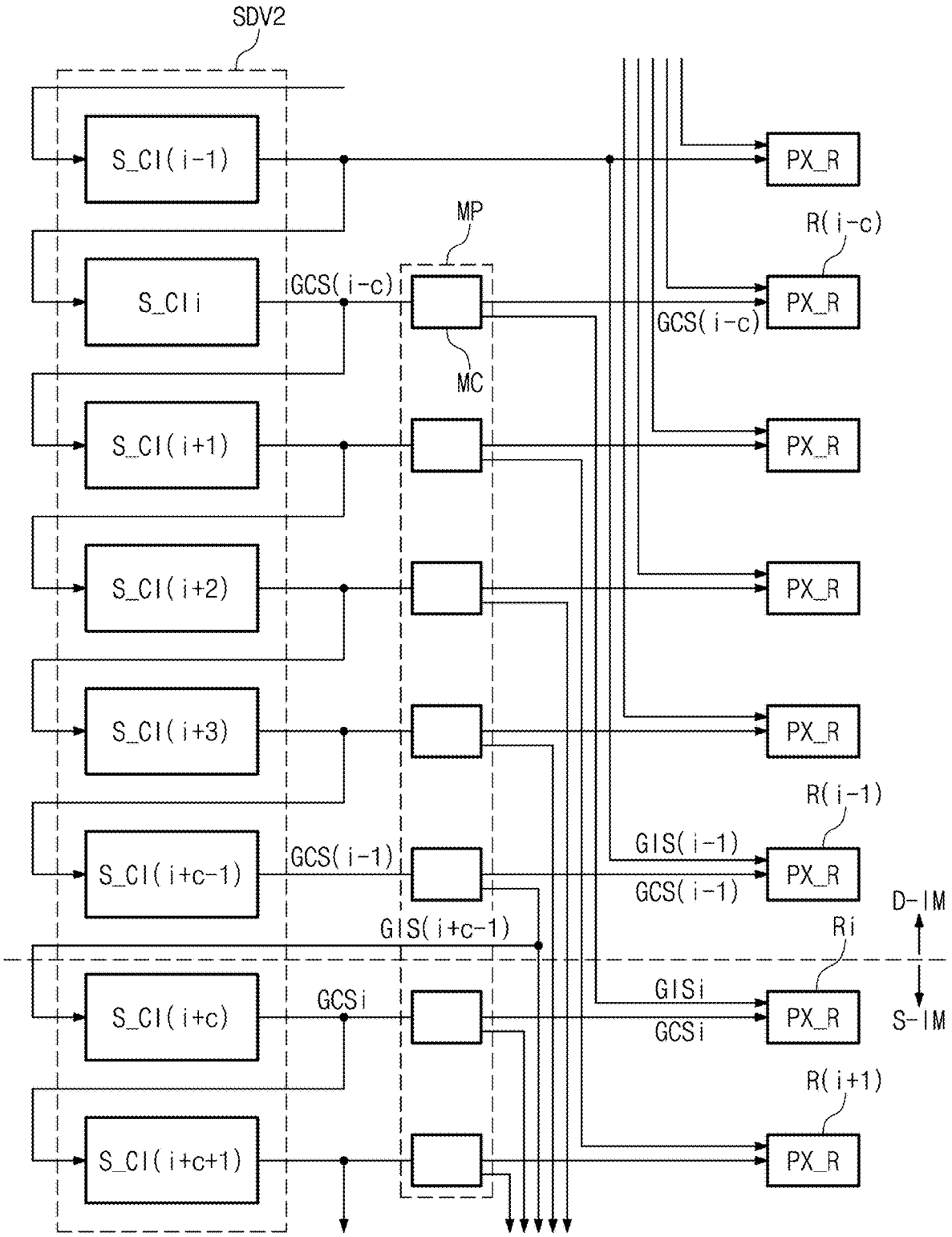
Figure 9:
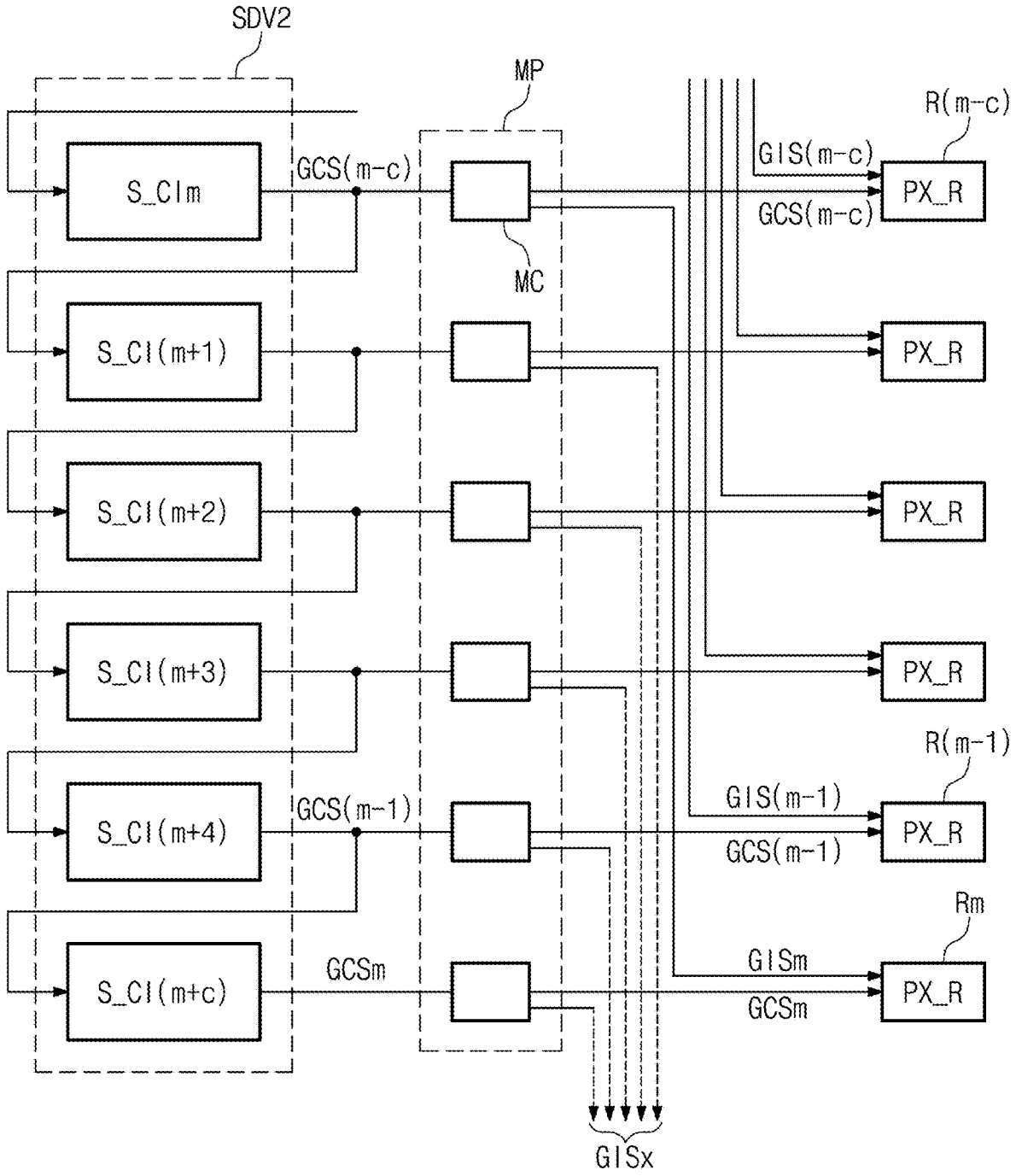

FIGS. 7, 8, and 9 are diagrams showing the configuration of a second scan driver of the scan driver shown in FIG. 1.

Illustratively, FIG. 7 shows an initial part of the second scan driver SDV2, FIG. 8 shows a middle part of a second scan driver SDV2 adjacent to a boundary between a moving image unit D-IM and a still image unit S-IM, and FIG. 9 shows an end part of the second scan driver SDV2.

Referring to FIGS. 7, 8, and 9, the scan driver SDV may include a second scan driver SDV2 and a masking part MP. The second scan driver SDV2 may generate compensation scan signals GCS1 to GCSm and initialization scan signals GIS1 to GISm and apply them to the display panel DP.

The compensation scan signals GCS1 to GCSm may be compensation scan signals GCS(1 to m) described with reference to FIG. 4. The initialization scan signals GIS1 to GISm may be initialization scan signals GIS(1 to m) described in FIG. 4.

The masking part MP is connected to the second scan driver SDV2, and may selectively apply initialization scan signals GISi to GISm to the still image unit S-IM. This operation will be described in detail below.

The second scan driver SDV2 may include m+c compensation-initialization stages S_CI1 to S_CI(m+c) that generate and output compensation and initialization scan signals GCS1 to GCSm and GIS1 to GISm. Here, c is a natural number of 2 or more. Hereinafter, the structure of the second scan driver SDV2 will be described with c being 5 as an example.

The pixels PX are arranged in m rows R1 to Rm, and the number of compensation-initialization stages S_CI1 to S_CI (m+c) may be larger by c than m rows. This reason will be described below with the timing chart of FIG. 11.

The first to m-th initialization scan signals GIS1 to GISm outputted from the first to m-th compensation-initialization stages S_CI1 to S_CIm may be applied to the pixels PX_R in the first to m-th rows R1 to Rm, respectively. The first to m-th compensation scan signals GCS1 to GCSm outputted from the (1+c)-th to (m+c)-th compensation-initialization stages S_CI(1+c) to S_CI(m+c) may be applied to the pixels PX_R in the first to m-th rows R1 to Rm, respectively.

Substantially, a compensation scan signal outputted from each of the first to (m+c)-th compensation-initialization stages S_CI1 to S_CI(m+c) may be used as an initialization scan signal. A structure in which the compensation scan signal is used as the initialization scan signal will be described in detail below.

Referring to FIG. 7, compensation scan signals GCSx outputted from the first to c-th compensation-initialization stages S_CI1 to S_CIc may not be applied to the pixels PX_R. The first to c-th compensation-initialization stages S_CI1 to S_CIc outputting the unused compensation scan signals GCSx may be defined as dummy stages.

The compensation scan signal GCSx outputted from the first compensation-initialization stage S_CI1 may be applied to the pixels PX_R of the first row R1 as a first initialization scan signal GIS1. The compensation scan signal GCSx outputted from the second compensation-initialization stage S_CI2 may be applied to the pixels PX_R of the second row R2 as a second initialization scan signal GIS2.

The compensation scan signal GCSx outputted from the third compensation-initialization stage S_CI3 may be applied to the pixels PX_R of the third row R3 as a third initialization scan signal GIS3. The compensation scan signals GCSx outputted from the fourth to c-th compensation-initialization stages S_CI4 to S_CIc may be used as the fourth to c-th initialization scan signals GIS4 to GISc, respectively.

The first compensation scan signal GCS1 outputted from the (1+c)-th compensation-initialization stage S_CI(1+c) may be applied to the pixels PX_R of the first row R1. The first compensation scan signal GCS1 may also be used as a (1+c)-th initialization scan signal GIS(1+c).

The second compensation scan signal GCS2 outputted from the (2+c)-th compensation-initialization stage S_CI(2+c) may be applied to the pixels PX_R of the second row R2. The second compensation scan signal GCS2 may also be used as a (2+c)-th initialization scan signal GIS(2+c).

The third compensation scan signal GCS3 outputted from the (3+c)-th compensation-initialization stage S_CI(3+c) may be applied to the pixels PX_R of the third row R3. The third compensation scan signal GCS3 may also be used as a (3+c)-th initialization scan signal GIS(3+c). As shown in FIGS. 7 to 9, this operation may be repeated until the (m+c)-th stage S_CI(m+c).

In FIG. 7, the first compensation-initialization stage S_CI1 may be driven by receiving the start signal FLM. Also, the current compensation-initialization stage may be driven by receiving a compensation scan signal outputted from the previous compensation-initialization stage.

In an embodiment, for example, the (1+c)-th compensation-initialization stage S_CI(1+c) may be driven by receiving a compensation scan signal GCSx outputted from the c-th compensation-initialization stage S_CIc. The (2+c)-th compensation-initialization stage S_CI(2+c) may be driven by receiving the first compensation scan signal GCS1 outputted from the (1+c)-th compensation-initialization stage S_CI(1+c). The compensation scan signal outputted from the previous compensation-initialization stage can be defined as a carry signal.

Hereinafter, the configuration of the second scan driver SDV2 and the masking part MP shown in FIGS. 8 and 9 will be described, and by way of example, only reference numerals for some signals necessary for description are shown in FIGS. 8 and 9.

Referring to FIGS. 8 and 9, the masking part MP may include a plurality of masking circuits MC connected to the i-th to (m+c)-th compensation-initialization stages S_CIi to S_CI(m+c), respectively, and selectively outputting the initialization signals GISi to GISm.

Compensation scan signals GCS(i−c) to GCSm and initialization scan signals GISi to GISm outputted from the i-th to (m+c)-th compensation-initialization stages S_CIi to S_CI(m+c), respectively, may be applied to the pixels PX_R through the masking circuits MC. In addition, initialization scan signals GISi to GISm outputted from the i-th to m-th compensation-initialization stages S_CIi to S_CIm) may be selectively applied to the pixels PX_R by the masking circuits MC. This operation will be described below with timing diagrams of FIGS. 11 and 13.

Referring to FIG. 8, the (i−c)-th compensation scan signal GCS(i−c) outputted from the i-th compensation-initialization stage S_CIi may be applied to the pixels PX_R of the (i−c)-th row R(i−c). The (i−c)-th compensation scan signal GCS(i−c) may be applied to the pixels PX_R of the i-th row Ri as an i-th initialization scan signal GISi.

The (i−c)-th compensation scan signal GCS(i−c) and the i-th initialization scan signal (GISi) may be applied to the pixels PX_R in the i−c-th row R(i−c) and the pixels PX_R in the i-th row Ri, respectively, through the corresponding masking circuit MC among the masking circuits MC.

The (i+c)-th compensation-initialization stage S_CI(i+c) may output an i-th compensation scan signal GCSi. The i-th compensation scan signal GCSi may be applied to the pixels PX_R of the i-th row.

Referring to FIG. 9, the (m−c)-th compensation scan signal GCS(m−c) outputted from the m-th compensation-initialization stage S_CIm may be applied to the pixels PX_R of the (m−c)-th row R(m−c). The (m−c)-th compensation scan signal GCS(m−c) may be applied to the pixels PX_R of the m-th row Rm as the m-th initialization scan signal GISm.

The (m−c)-th compensation scan signal GCS(m−c) and the m-th initialization scan signal GISm may be applied to the pixels PX_R of the (m−c)-th row R(m−c) and the pixels PX_R of the m-th row Rm, respectively, through the corresponding masking circuit MC among the masking circuits MC.

The m-th compensation scan signal GCS(m) outputted from the (m+c)-th compensation-initialization stage S_CI (m+c) may be applied to the pixels PX_R of the m-th row R(m) through a corresponding one of the masking circuits MC.

The initialization scan signals GISx outputted from the (m+1)-th to (m+c)-th compensation-initialization stages S_CI(m+1) to S_CI(m+c) may not be applied to the pixels PX_R.

Referring to FIG. 8, the (i+c)-th compensation-initialization stage S_CI(i+c) may be driven by receiving the (i+c−1)-th initialization scan signal GIS(i+c−1) outputted from the (i+c−1)-th compensation-initialization stage S_CI(i+c−1). That is, the (i+c)-th compensation-initialization stage S_CI(i+c) may receive the (i+c−1)-th initialization scan signal GIS(i+c−1) instead of the (i−1)-th compensation scan signal GCS(i−1) outputted from the previous (i+c−1)-th compensation-initialization stage S_CI(i+c−1).

In the remaining compensation-initialization stages except for the (i+c)-th compensation-initialization stage S_CI(i+c), as described with reference to FIG. 7, the current compensation-initialization stage may be driven by receiving a compensation scan signal outputted from the previous compensation-initialization stage.

Figure 10:
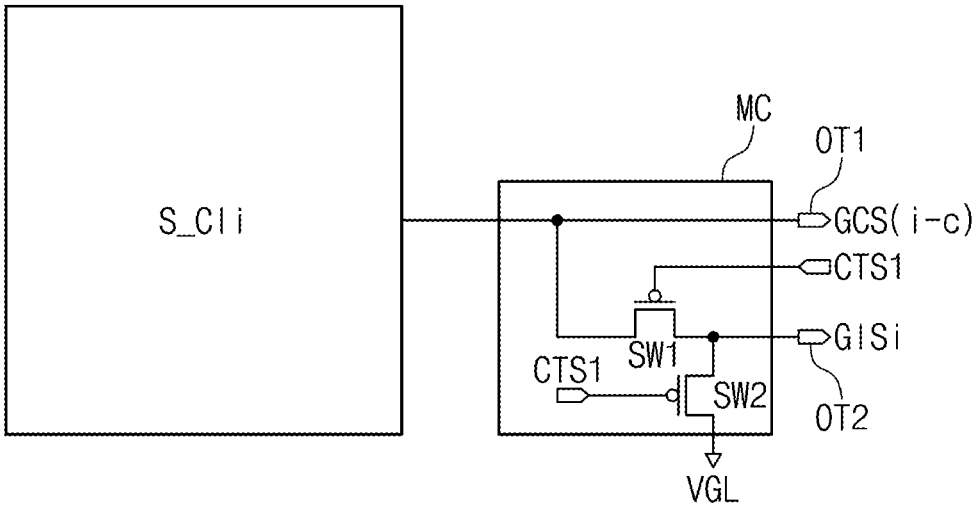
FIG. 10 is a diagram illustrating a configuration of one of the masking circuits shown in FIGS. 8 and 9.

FIG. 10 is a diagram illustrating a configuration of one of the masking circuits shown in FIGS. 8 and 9.

For example, in FIG. 10, a masking circuit MC connected to the i-th compensation-initialization stage S_CIi is shown.

Referring to FIG. 10, the masking circuit MC may include a first switching element SW1 connected to the i-th compensation-initialization stage S_CIi and a second switching element SW2 connected to the first switching element SW1. The first switching element SW1 and the second switching element SW2 may include a PMOS transistor, but are not limited thereto and may include an NMOS transistor in another embodiment.

The first switching element SW1 may output an (i−c)-th compensation scan signal GCS(i−c) received from the i-th compensation-initialization stage S_CIi as an i-th initialization scan signal GISi in response to the first control signal CTS1. The second switching element SW2 may deactivate the i-th initialization scan signal GISi outputted from the first switching element SW1 in response to the second control signal CTS2.

The activated i-th initialization scan signal GISi may have a high level, and the deactivated i-th initialization scan signal GISi may have a low level. The second switching element SW2 may receive a voltage VGL having a low level for deactivating the i-th initialization scan signal GISi.

The i-th compensation-initialization stage S_CIi may be connected to the first output terminal OT1 of the masking circuit MC for outputting the (i−c)-th compensation scan signal GCS(i−c) and the second output terminal OT2 of the masking circuit MC for outputting the i-th initialization scan signal GISi.

The first switching element SW1 may include an input electrode (i.e., source electrode) connected to the first output terminal OT1 of the masking circuit MC, a control electrode (i.e., gate electrode) for receiving the first control signal CTS1, and an output electrode (i.e., drain electrode) connected to the second output terminal OT2 of the masking circuit MC. The second switching element SW2 may include an input electrode (i.e., source electrode) connected to the second output terminal OT2 of the masking circuit MC, a control electrode (i.e., gate electrode) receiving a second control signal CTS2, and an output electrode (i.e., drain electrode) receiving the voltage VGL.

The first control signal CTS1 and the second control signal CTS2 may have different levels at the same time. When the first control signal CTS1 has a high level, the second control signal CTS2 may have a low level. Also, when the first control signal CTS1 has a low level, the second control signal CTS2 may have a high level.

Figure 11:
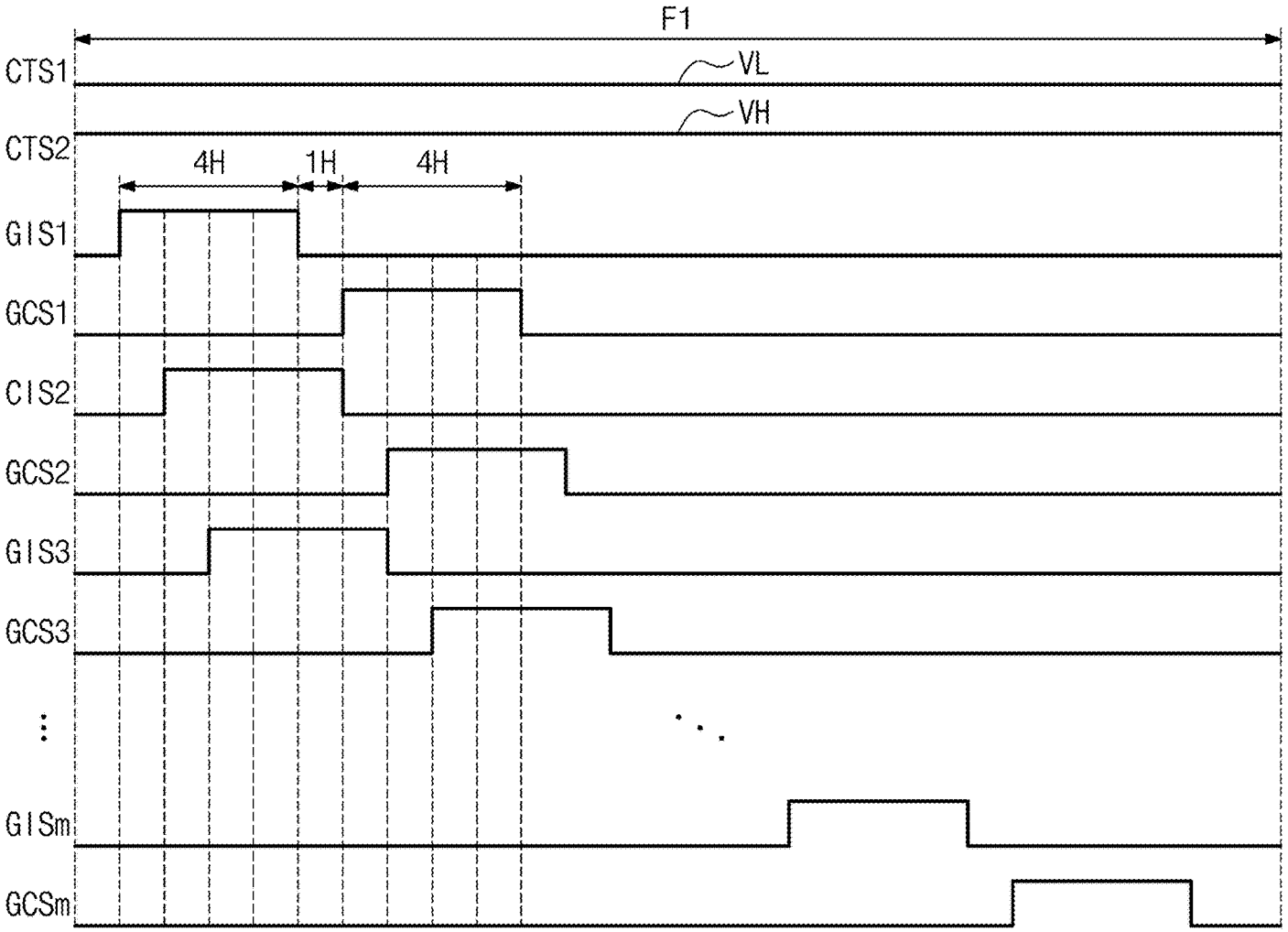
FIG. 11 is a timing diagram illustrating operations of a second scan driver and a masking part shown in FIGS. 7 to 9 in a first frame.
Figure 12:
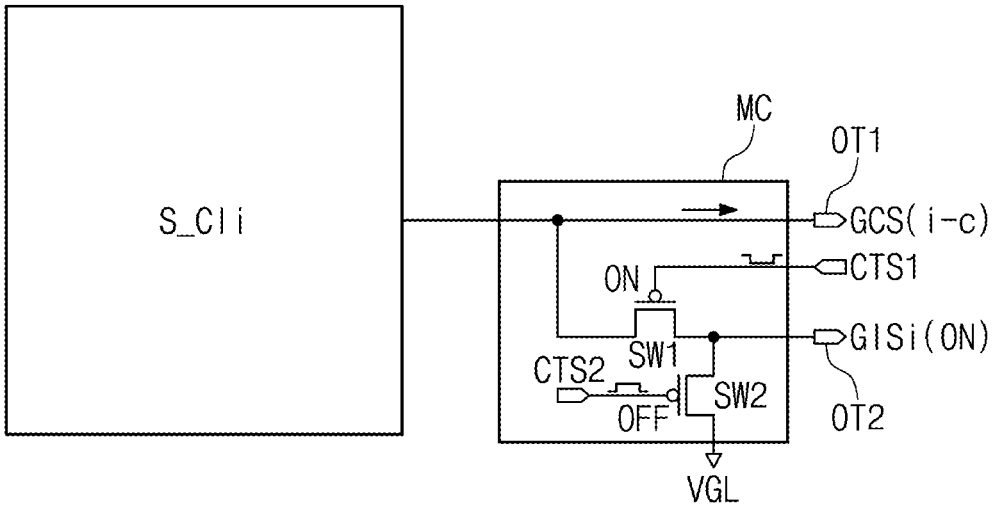
FIG. 12 is a diagram for describing an operation of a masking circuit according to first and second control signals shown in FIG. 11.

FIG. 11 is a timing diagram illustrating operations of a second scan driver and a masking part shown in FIGS. 7 to 9 in a first frame. FIG. 12 is a diagram for describing an operation of a masking circuit according to first and second control signals shown in FIG. 11.

Hereinafter, the second scan driver SDV2 and the masking part MP shown in FIGS. 7 to 9 will be described together as needed for explanation.

Referring to FIGS. 7 to 9 and 11, in the first frame F1, the first to m-th initialization scan signals GIS1 to GISm outputted from the first to m-th compensation-initialization stages S_CI1 to S_CIm may be sequentially applied to the pixels PX_R of the first to m-th rows R1 to Rm in row units.

In the first frame F1, the first to m-th compensation scan signals GCS1 to GCSm outputted from the (1+c)-th to (m+c)-th compensation-initialization stages S_CI(1+c) to S_CI(m+c) may be sequentially applied in row units to the pixels PX_R of the first to m-th rows R1 to Rm.

The compensation scan signal and initialization scan signal applied to the same row may not overlap each other. For example, each of the first to m-th initialization scan signals GIS1 to GISm may have an activation section 4H of 4H. Each of the first to m-th compensation scan signals GCS1 to GCSm may have an activation section 4H of 4H.

In this case, m compensation-initialization stages corresponding to m rows R1 to Rm and 5 additional compensation-initialization stages may be required for the operation of the pixels PX_R. For example, c may be set to a value obtained by adding 1 to 4 corresponding to the activation section 4H of 4H. However, the inventive concept is not limited thereto, and c may be set to various values according to activation sections of compensation and initialization scan signals GIS1 to GISm and GIS1 to GISm.

Taking the first initialization scan signal GIS1 and the first compensation scan signal GCS1 as an example, a first initialization scan signal GIS1 having an activation section 4H of 4H may be outputted from the first compensation-initialization stage S_CI1 shown in FIG. 7. Thereafter, the four compensation-initialization stages may be skipped, and then a first compensation scan signal GCS1 having an activation section 4H of 4H may be outputted from the (1+c)-th compensation-initialization stage S_CI(1+c) shown in FIG. 7.

In this case, the first compensation scan signal GCS1 may be outputted by delaying five times 1H from the first initialization scan signal GIS1. Accordingly, the first compensation scan signal GCS1 may be spaced apart from the first initialization scan signal GIS1 by 1H and may not overlap the first initialization scan signal GIS1. When the compensation scan signal and the initialization scan signal applied to the same row do not overlap each other, the above-described initialization operation and compensation operation of the pixel PX may be normally performed.

The first to m-th initialization scan signals GIS1 to GISm may be sequentially outputted after being delayed by a section of 1H. The first to m-th compensation scan signals GCS1 to GCSm may be sequentially outputted after being delayed by a section of 1H.

Referring to FIGS. 11 and 12, in the first frame F1, the first control signal CTS1 may have a low level VL (or a low level voltage), and the second control signal CTS2 may have a high level VH (or a high level voltage). A first control signal CTS1 having a low level VL may be defined as an activated state, and a second control signal CTS2 having a high level VH may be defined as a deactivated state.

During the first frame F1, the first switching element SW1 may be turned on in response to the activated first control signal CTS1. During the first frame F1, the second switching element SW2 may be turned off in response to the deactivated second control signal CTS2.

In FIG. 12, the (i−c)-th compensation scan signal GCS (i−c) may be outputted through the first output terminal OT1 of the masking circuit MC, and the i-th initialization scan signal GISi may be outputted through the turned-on first switching element SW1 and the second output terminal OT2 of the masking circuit MC. In this case, in FIGS. 8 and 9, the compensation and initialization scan signals outputted from the i-th to (m+c)-th compensation-scan stages S_CIi to S_CI(m+c) may be outputted through the masking circuits MC.

Figure 13:
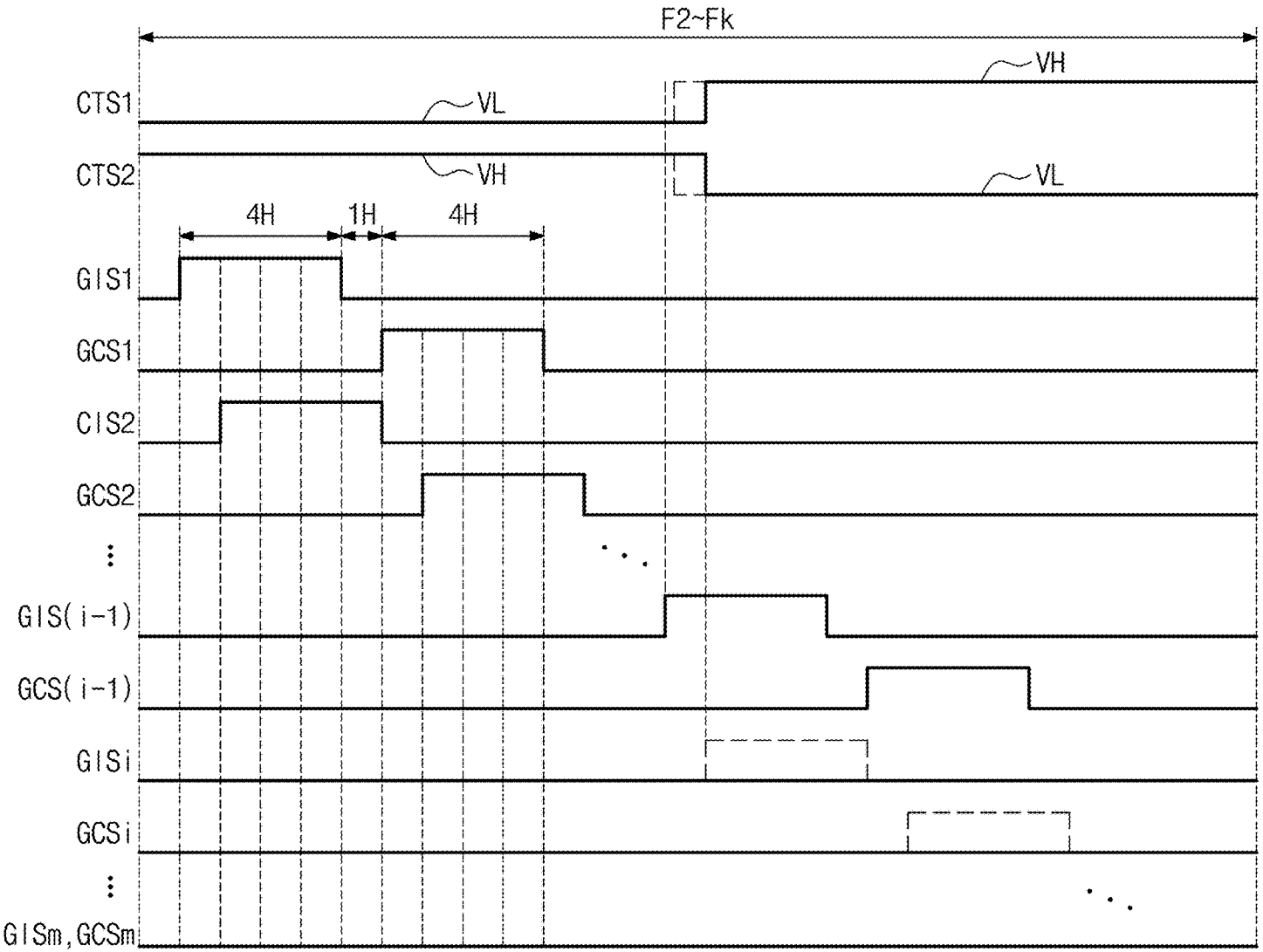
FIG. 13 is a timing diagram illustrating operations of the second scan driver and the masking part shown in FIGS. 7 to 9 in each of the second to k-th frames.
Figure 14:
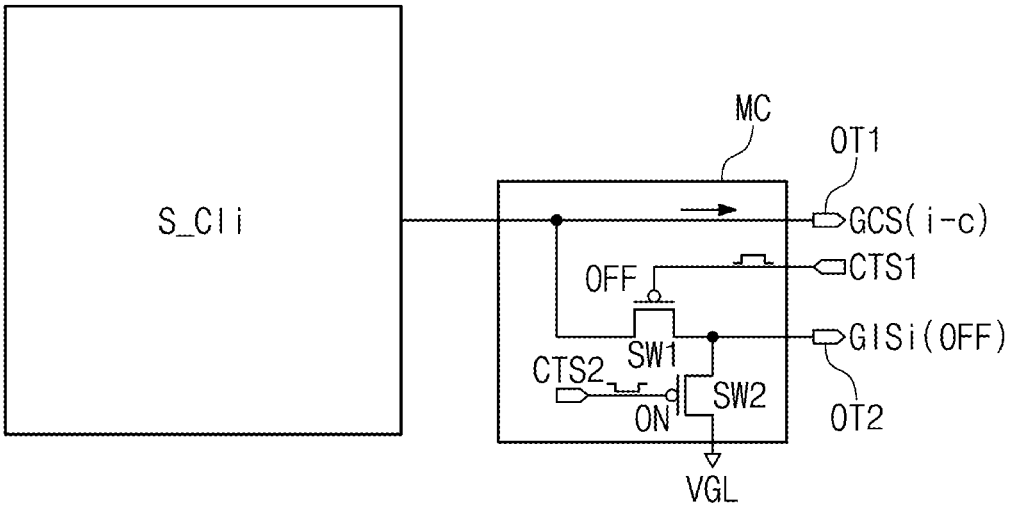
FIG. 14 is a diagram for describing an operation of a masking circuit according to first and second control signals shown in FIG. 13.
Figure 15:
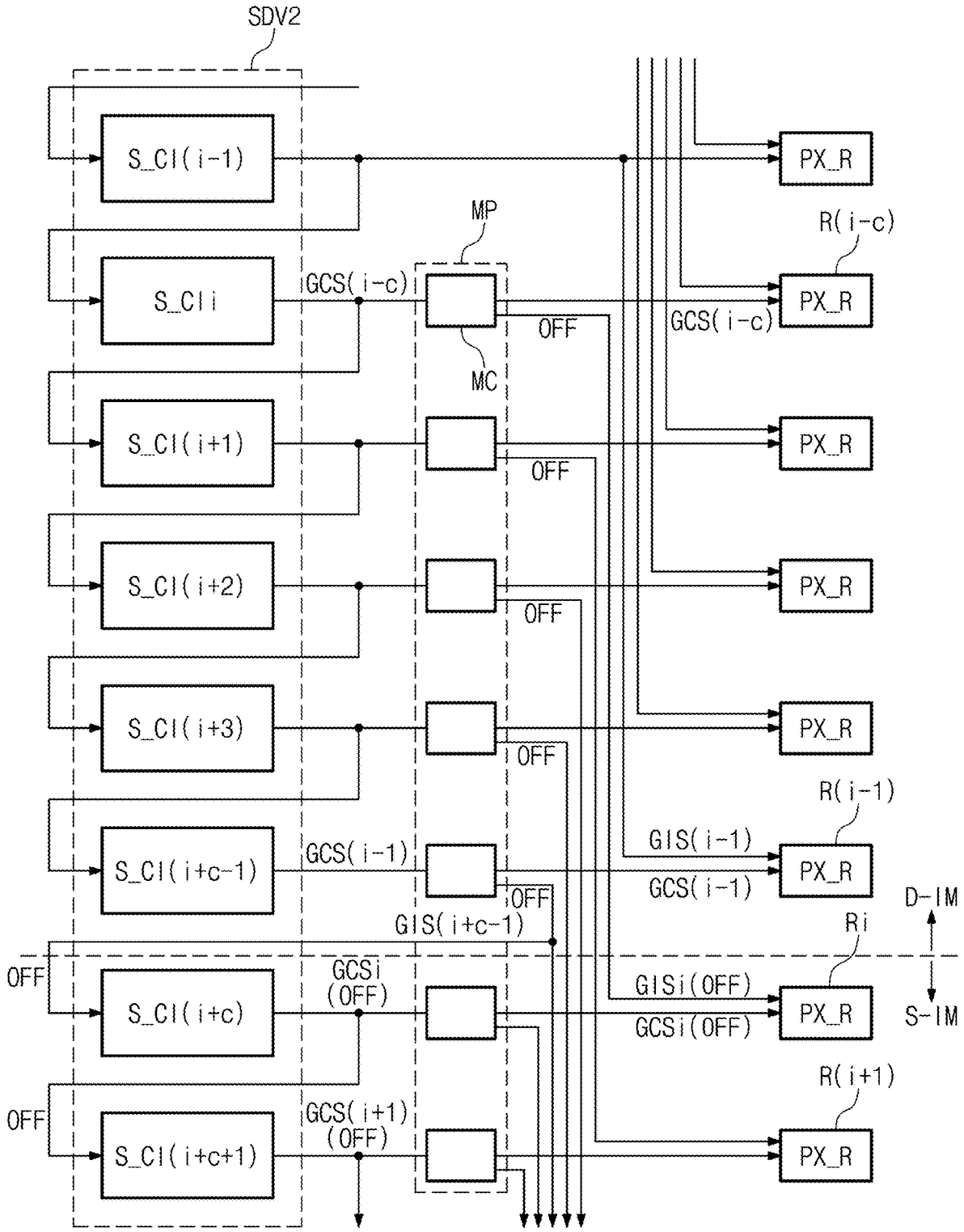
FIG. 15 is a diagram illustrating an output state of a masking circuit according to first and second control signals illustrated in FIG. 13.

FIG. 13 is a timing diagram illustrating operations of the second scan driver and the masking part shown in FIGS. 7 to 9 in each of the second to k-th frames. FIG. 14 is a diagram for describing an operation of a masking circuit according to first and second control signals shown in FIG. 13. FIG. 15 is a diagram illustrating an output state of a masking circuit according to first and second control signals illustrated in FIG. 13.

Hereinafter, the second scan driver SDV2 and the masking part MP shown in FIGS. 7 to 9 will be described together as needed for explanation.

Referring to FIGS. 7 to 9 and 13, in each of the second to k-th frames F2 to Fk, the first to (i−1)-th initialization scan signals GIS1 to GIS(i−1) may be applied to the pixels PX_R of the first to (i−1)-th rows R1 to R(i−1) displaying a moving image. In each of the second to k-th frames F2 to Fk, the first to (i−1)-th compensation scan signals GCS1 to GCS(i−1) may be applied to the pixels PX_R of the first to (i−1)-th rows R1 to Rm displaying a moving image.

In the second to k-th frames F2 to Fk, the i-th to m-th initialization scan signals GISi to GISm and the i-th to m-th compensation scan signals GCSi to GCSm may not be applied to the pixels PX_R of i-th to m-th rows Ri to Rm displaying a still image.

After the (i−1)-th initialization scan signal GIS(i−1) is outputted, the first control signal CTS1 may be deactivated at the high level VH, and the second control signal CTS2 may be activated at the low level VL. Exemplarily, when the i-th initialization scan signal GISi is activated, the first control signal CTS1 may be deactivated, and the second control signal CTS2 may be activated.

However, the inventive concept is not limited thereto, and as shown by dotted lines of the first and second control signals CTS1 and CTS2 in FIG. 13, before the i-th initialization scan signal GISi is activated, the first control signal CTS1 may be deactivated, and the second control signal CTS2 may be activated.

Referring to FIGS. 8, 9, 13, and 14, in the second to k-th frames F2 to Fk, the masking part MP may turn off the i-th to (m+c)-th initialization scan signals GISi to GISm and GISx outputted from the i-th to (m+c)-th compensation-initialization stages S_CIi to S_CI(m+c).

In an embodiment, for example, as shown in FIG. 14, during the second to k-th frames F2 to Fk, the first switching element SW1 may be turned off in response to the deactivated first control signal CTS1. During the second to k-th frames F2 to Fk, the second switching element SW2 may be turned on in response to the activated second control signal CTS2.

In order to turn off the i-th initialization scan signal GISi, the turned-on second switching element SW2 may pull-down the i-th initialization scan signal GISi to a level of the voltage VGL having a low level. The masking circuits MC may pull down the i-th to (m+c)-th initialization scan signals GISi to GISm and GISx to the level of the voltage VGL having a low level.

Thus, during the second to k-th frames F2 to Fk, the i-th to m-th initialization scan signals GISi to GISm may be deactivated, and the i-th to m-th initialization scan signals GISi to GISm may not be applied to the still image unit S-IM.

Referring to FIGS. 8, 13, and 14, the masking part MP may apply the (i−c)-th to (i−1)-th compensation scan signals GCS(i−c) to GCS(i−1) outputted from the i-th to (i+c−1)-th compensation-initialization stages S_CIi to S_CI(i+c−1) to the pixels PX_R of the (i−c)-th to (i−1)-th rows R(i−c) to R(i−1).

The masking part MP connected to the i-th to (i+c−1)-th compensation-initialization stages S_CIi to S_CI(i+c−1) may apply the (i−c)-th to (i−1)-th compensation scan signals GCS(i−c) to GCS(i−1) to the pixels PX_R of the (i−c)-th to (i−1)-th rows R(i−c) to R(i−1).

If the masking part MP is not used, in order not to apply the i-th to m-th initialization scan signals GISi to GISm to the pixels PX_R, the i-th to (m+c)-th compensation-initialization stages S_CIi to S_CI(m+c) may be forcibly turned off. In this case, since the i-th to (i+c−1)-th compensation-initialization stages S_CIi to S_CI(i+c−1) are turned off, the (i−c)-th to (i−1)-th compensation scan signals GCS(i−c) to GCS(i−1) may be deactivated and may not be outputted.

Since the (i−c)-th to (i−1)-th compensation scan signals GCS(i−c) to GCS(i−1) are not applied to the pixels PX_R of the (i−c)-th to (i−1)-th rows R(i−c) to R(i−1), the compensation operation for the pixels PX_R in the (i−c)-th to (i−1)-th rows R(i−c) to R(i−1) may not be performed.

However, in the embodiment of the inventive concept, since the (i−c)-th to (i−1)-th compensation scan signals GCS(i−c) to GCS(i−1) are applied to the pixels PX_R of the (i−c)-th to (i−1)-th rows R(i−c) to R(i−1), a compensation operation may be performed on the pixels PX_R of the (i−c)-th to (i−1)-th rows R(i−c) to R(i−1).

Consequently, in an embodiment of the inventive concept, as compensation scan signals are applied to the pixels PX_R of the moving image unit D-IM adjacent to the still image unit S-IM, the compensation operation for the pixels PX_R of the moving image unit D-IM adjacent to the still image unit S-IM may be normally performed.

Referring to FIGS. 13, 14, and 15, an OFF display indicates a state in which signals are deactivated. The (i+c−1)-th initialization scan signal GIS(i+c−1) outputted from the (i+c−1)-th compensation-initialization stage S_CI(i+c−1) may be deactivated to a low level and may be turned off.

The (i+c)-th compensation-initialization stage S_CI(i+c) may receive the (i+c−1)-th initialization scan signal GIS(i+c−1) outputted from the (i+c−1)-th compensation-initialization stage S_CI(i+c−1). In the second to k-th frames F2 to Fk, the (i+c)-th compensation-initialization stage S_CI(i+c) receiving the deactivated (i+c−1)-th initialization scan signal GIS(i+c−1) may be deactivated and may not operate. That is, the i-th compensation scan signal GCSi outputted from the (i+c)-th compensation-initialization stage S_CI(i+c) may be deactivated and turned off.

Since each of the compensation-initialization stages S_CI(i+c+1) to S_CI(m+c) receives the deactivated compensation scan signal of the previous stage after the (i+c)-th compensation-initialization stage S_CI(i+c), it can also be deactivated. Therefore, in the second to k-th frames F2 to Fk, the i-th to m-th compensation scan signals GCSi to GCSm may not be applied to the still image unit S-IM.

Figure 16:
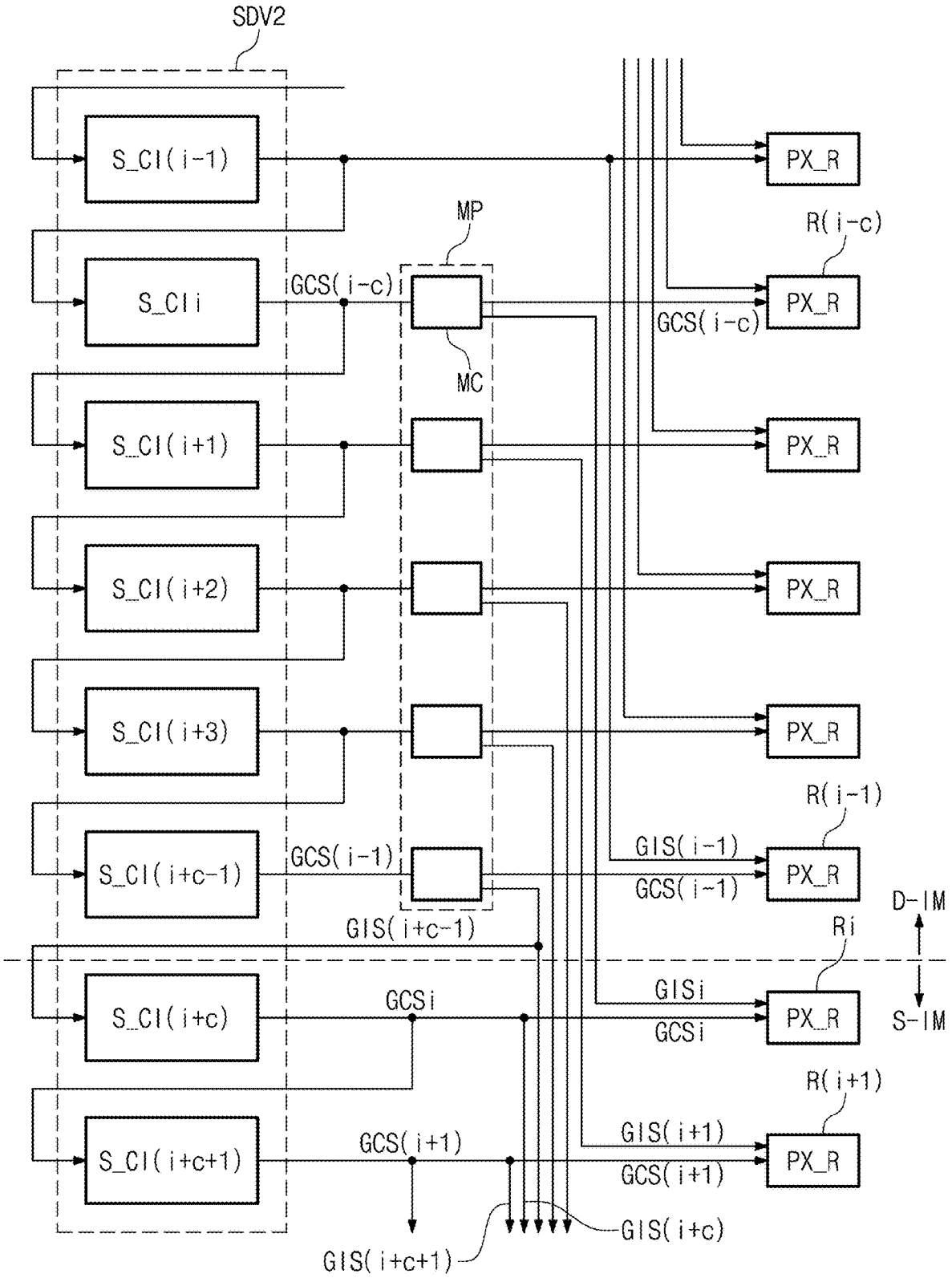
FIG. 16 is a diagram illustrating a configuration of a masking unit according to another embodiment of the inventive concept.

FIG. 16 is a diagram illustrating a configuration of a masking unit according to another embodiment of the inventive concept.

In an embodiment, for example, the second scan driver SDV2 of FIG. 16 is illustrated as a second scan driver SDV2 corresponding to FIG. 8. Except for the number of mask circuits MC used, the configuration shown in FIG. 16 may be substantially the same as the configuration shown in FIG. 8.

Referring to FIG. 16, the masking part MP may include a plurality of mask circuits MC connected to the i-th to (i+c−1)-th compensation-initialization stages S_CIi to S_CI(i+c−1), not the (i+c)-th to (m+c)-th compensation-initialization stages S_CI(i+c) to S_CI(m+c). In the second to k-th frames F2 to Fk, the mask circuits MC may apply the (i−c)-th to (i−1)-th compensation scan signals GCS(i−c) to GCS(i−1) to the pixels PX_R of the (i−c)-th to (i−1)-th rows R(i−c) to R(i−1).

In the second to k-th frames F2 to Fk, the mask circuits MC may deactivate the i-th to (i+c−1)-th initialization scan signals GISi to GIS(i+c−1) outputted from the i-th to (i+c−1)-th compensation-initialization stages S_CIi to S_CI(i+c−1), respectively. Accordingly, the i-th to (i+c−1)-th initialization scan signals GISi to GIS(i+c−1) may not be applied to the still image unit S-IM.

As mentioned above, the (i+c)-th compensation-initialization stage S_CI(i+c) may receive a deactivated (i+c−1)-th initialization scan signal GIS(i+c−1). Accordingly, the i-th compensation scan signal GCSi outputted from the (i+c)-th compensation-initialization stage S_CI(i+c) may be deactivated and turned off. In addition, an (i+c)-th initialization scan signal GIS(i+c) outputted as an i-th compensation scan signal GCSi may also be deactivated and turned off.

The (i+c+1)-th compensation-initialization stage S_CI(i+c+1) may receive a deactivated i-th compensation scan signal GCSi. Therefore, the (i+1)-th compensation scan signal GCS(i+1) and the (i+c+1)-th initialization scan signal GIS(i+c+1) outputted from the (i+c+1)-th compensation-initialization stage S_CI(i+c+1) may also be deactivated and turned off. This operation may be performed until the last compensation-initialization stage S_CI(m+c).

Therefore, in the second to k-th frames F2 to Fk, the i-th to m-th initialization scan signals GISi to GISm and the i-th to m-th compensation scan signals GCSi to GCSm may not be applied to the still image unit S-IM.

Figure 17:
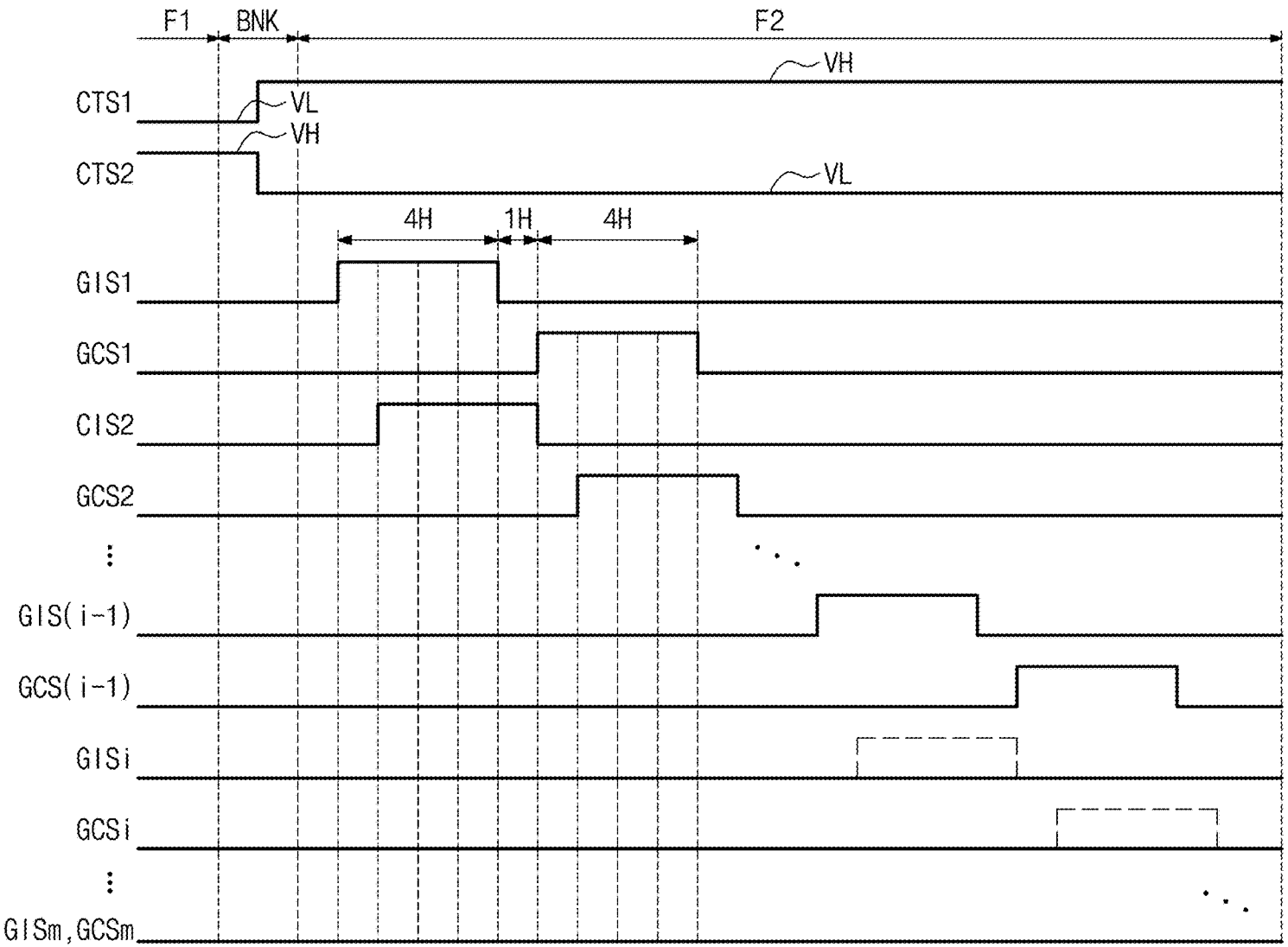
FIG. 17 is a diagram showing timings of first and second control signals according to another embodiment of the inventive concept.

FIG. 17 is a diagram showing timings of first and second control signals according to another embodiment of the inventive concept.

Illustratively, similar to FIG. 13, FIG. 17 shows the timing of signals in the second frame.

Referring to FIG. 17, the first control signal CTS1 and the second control signal CTS2 may be deactivated and activated after the first frame F1 and before the second frame F2 displaying a still image. For example, in the blanking section BNK between the first frame F1 and the second frame F2, the first control signal CTS1 may be deactivated and the second control signal CTS2 may be activated.

The masking circuits MC have a function of turning off initialization scan signals GISi to GISm and compensation scan signals GCSi to GCSm applied to the still image unit S-IM from the second frame F2. Accordingly, the level of the first control signal CTS1 and the level of the second control signal CTS2 may be changed before the start of the second frame F2. When the first control signal CTS1 is deactivated and the second control signal CTS2 is activated, the operation of the masking circuits MC has been described in detail above, and thus a description thereof will be omitted.

According to an embodiment of the inventive concept, compensation scan signals are applied to the pixels of the moving image unit adjacent to the still image unit such that the compensation operation for pixels of a moving image unit adjacent to the still image unit may be normally performed.

Although the embodiments of the inventive concept have been described, it is understood that the inventive concept should not be limited to these embodiments but various changes and modifications can be made by one ordinary skilled in the art within the spirit and scope of the inventive concept as hereinafter claimed.

What is claimed is:

1. A display device comprising:

a display panel including a first image unit and a second image unit;

a data driver which applies data voltages to the display panel;

a first scan driver which applies write scan signals to the display panel;

a second scan driver which applies compensation scan signals and initialization scan signals to the display panel; and a masking part connected to the second scan driver and which selectively applies the initialization scan signals to the second image unit.

2. The display device of claim 1, wherein the first image unit displays a moving image, and the second image unit displays a still image.

3. The display device of claim 1, wherein the first image unit comprises pixels in first to (i−1)-th rows, and the second image unit comprises pixels in i-th to m-th rows, wherein the pixels of the first and second image units are driven by k frames, and during a first frame, the pixels receive the write scan signals, the compensation scan signals, the initialization scan signals, and the data voltages, wherein m is a natural number, i and k are natural numbers of 2 or more, and i is equal to or less than m.

4. The display device of claim 3, wherein during the second to k-th frames, the write scan signals are applied to the pixels of the first and second image units, wherein during the second to k-th frames, the data voltages are applied to the pixels of the first image unit, and a reference voltage is applied to the pixels of the second image unit, wherein during the second to k-th frames, the compensation scan signals and the initialization scan signals are applied to the pixels of the first image unit, and are not applied to the pixels of the second image unit.

5. The display device of claim 3, wherein the first scan driver comprises a plurality of write stages which sequentially outputs the write scan signals, wherein pixels in an h-th row of the first to m-th rows receive an h-th write scan signal outputted from an h-th write stage of the plurality of write stages and an (h−1)-th write scan signal outputted from an (h−1)-th write stage of the plurality of write stages, wherein h is a natural number.

6. The display device of claim 3, wherein the second scan driver comprises m+c compensation-initialization stages which output the compensation scan signals and the initialization scan signals, wherein c is a natural number of 2 or more.

7. The display device of claim 6, wherein the initialization scan signals include first to m-th initialization scan signals, and the compensation scan signals include first to m-th compensation scan signals, wherein in the first frame, the first to m-th initialization scan signals outputted from first to m-th compensation-initialization stages of the m+c compensation-initialization stages are sequentially applied to the pixels of the first to m-th rows in row units, and the first to m-th compensation scan signals outputted from (1+c)-th to (m+c)-th compensation-initialization stages of the m+c compensation-initialization stages are sequentially applied to the pixels of the first to m-th rows in row units.

8. The display device of claim 6, wherein in the second to k-th frames, the masking part turns off initialization scan signals outputted from i-th to (m+c)-th compensation-initialization stages.

9. The display device of claim 6, wherein in the second to k-th frames, the masking part applies compensation scan signals outputted from i-th to (i+c−1)-th compensation-initialization stages to pixels in (i−c)-th to (i−1)-th rows, respectively.

10. The display device of claim 6, wherein the masking part comprises a plurality of masking circuits connected to i-th to (i+c−1)-th compensation-initialization stages of the m+c compensation-initialization stages, respectively, wherein the plurality of masking circuits selectively outputs i-th to (i+c−1)-th initialization scan signals of the initialization scan signals received from the i-th to (i+c−1)-th compensation-initialization stages.

11. The display device of claim 6, wherein an (i+c)-th compensation-initialization stage which applies an i-th compensation scan signal to the pixels in an i-th row of the first to m-th rows is driven by receiving an (i+c−1)-th initialization scan signal outputted from an (i+c−1)-th compensation-initialization stage.

12. The display device of claim 11, wherein in the compensation-initialization stages excluding the (i+c)-th compensation-initialization stage, a current compensation-initialization stage is driven by receiving a compensation scan signal outputted from a previous compensation-initialization stage.

13. The display device of claim 6, wherein the masking part comprises a plurality of masking circuits connected to i-th to (m+c)-th compensation-initialization stages, respectively, to selectively output the initialization scan signals.

14. The display device of claim 13, wherein each of the masking circuits comprises:

a first switching element which outputs a compensation scan signal received from a corresponding compensation-initialization stage among the compensation-initialization stages as the initialization scan signal, in response to a first control signal; and a second switching element which deactivates the initialization scan signal outputted from the first switching element, in response to a second control signal.

15. The display device of claim 14, wherein the first control signal has a level different from a level of the second control signal.

16. The display device of claim 14, wherein the first switching element comprises:

an input electrode connected to a first output terminal of the masking circuit to output the compensation scan signal;

a control electrode which receives the first control signal; and an output electrode connected to a second output terminal of the masking circuit to output the initialization scan signal, wherein the second switching element comprises:

an input electrode connected to the second output terminal;

a control electrode which receives the second control signal; and an output electrode which receives a voltage having a level for deactivating the initialization scan signal.

17. The display device of claim 14, wherein during the first frame, the first switching element is turned on in response to the first control signal in an activated state, and the second switching element is turned off in response to the second control signal in a deactivated state, wherein during second to k-th frames, the first switching element is turned off in response to the first control signal in a deactivated state, and the second switching element is turned on in response to the second control signal an activated state.

18. The display device of claim 17, wherein in the second to k-th frames, the first control signal is deactivated and the second control signal is activated when an i-th initialization scan signal of the initialization scan signals is activated.

19. The display device of claim 17, wherein between the first frame and the second frame, the first control signal is deactivated, and the second control signal is activated.

20. A display device comprising:

a display panel including a first image unit with pixels in first to (i−1)-th rows and a second image unit with pixels in i-th to m-th rows;

a data driver which applies data voltages to the display panel;

a first scan driver which applies write scan signals to the display panel;

a second scan driver which applies compensation scan signals and initialization scan signals to the display panel; and a masking part connected to the second scan driver, wherein the second scan driver comprises m+c compensation-initialization stages which output the compensation and initialization scan signals, wherein the masking part comprises a plurality of masking circuits connected to i-th to (i+c−1)-th compensation-initialization stages of the m+c compensation-initialization stages, respectively, and the plurality of masking circuits selectively output i-th to (i+c−1)-th initialization scan signals received from the i-th to (i+c−1)-th compensation-initialization stages, respectively, wherein i, m, c are natural numbers, and i is 2 or more and equal to or less than m.

* * * * *